US011465256B2

(12) United States Patent
Sotozaki et al.

(10) Patent No.: US 11,465,256 B2
(45) Date of Patent: Oct. 11, 2022

(54) APPARATUS FOR POLISHING AND METHOD FOR POLISHING

(71) Applicant: EBARA CORPORATION, Tokyo (JP)

(72) Inventors: Hiroshi Sotozaki, Tokyo (JP); Pohan Chen, Tokyo (JP); Tadakazu Sone, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 96 days.

(21) Appl. No.: 16/533,018

(22) Filed: Aug. 6, 2019

(65) Prior Publication Data

US 2020/0039029 A1 Feb. 6, 2020

(30) Foreign Application Priority Data

Aug. 6, 2018 (JP) ..... JP147915/2018

(51) Int. Cl.
*B24B 53/017* (2012.01)

(52) U.S. Cl.
CPC ..... *B24B 53/017* (2013.01)

(58) Field of Classification Search
CPC ..... B24B 37/005; B24B 37/015; B24B 37/04; B24B 37/042; B24B 49/14; B24B 53/017; B24B 55/02; B24B 55/12; B24B 57/00; B24B 57/02; H01L 21/67028
USPC ..... 451/446, 36, 41, 60, 53, 7, 449, 450
See application file for complete search history.

(56) References Cited

U.S. PATENT DOCUMENTS 3,379,347 A * 4/1968 Melchiorre ..... B24B 57/00 222/231
5,578,529 A * 11/1996 Mullins ..... B08B 3/02 438/692
5,584,749 A * 12/1996 Mitsuhashi ..... B24B 37/04 451/36

(Continued)

FOREIGN PATENT DOCUMENTS

CN 1672876 S 9/2005
CN 106475896 A * 3/2017 ..... B24B 37/10

(Continued)

OTHER PUBLICATIONS

U.S. Appl. No. 16/532,934; Non-Final Office Action; dated Dec. 24, 2021; 7 pages.

*Primary Examiner* — Orlando E Aviles
*Assistant Examiner* — Jonathan R Zaworski
(74) *Attorney, Agent, or Firm* — BakerHostetler

(57) ABSTRACT

There is provided an apparatus for polishing an object to be polished using a polishing pad having a polishing surface, the apparatus including a polishing table for supporting the polishing pad, the polishing table being configured to be rotatable, a substrate holding unit configured to hold the object to be polished and pressing the object to be polished against the polishing pad, and a polishing-liquid removing unit configured to remove polishing liquid from the polishing surface. The polishing-liquid removing unit includes a rinse unit configured to jet cleaning liquid onto the polishing surface and a sucking unit configured to suck the polishing liquid on the polishing surface onto which the cleaning liquid is jetted. The rinse unit includes a cleaning space surrounded by a sidewall. The sidewall includes an opening section for opening the cleaning space toward a radial direction outer side of the polishing table.

10 Claims, 40 Drawing Sheets

(56) References Cited

U.S. PATENT DOCUMENTS 5,645,682 A * 7/1997 Skrovan ..... B24B 53/00 438/692
5,651,725 A * 7/1997 Kikuta ..... B24B 53/00 451/286
5,755,614 A * 5/1998 Adams ..... B24B 55/03 451/60
5,846,336 A * 12/1998 Skrovan ..... B24B 53/00 134/32
5,866,480 A 2/1999 Murakami et al.
5,893,753 A * 4/1999 Hempel, Jr. ..... B24B 37/042 438/693
5,916,010 A * 6/1999 Varian ..... B24B 53/017 451/72
6,012,967 A * 1/2000 Satake ..... B24B 57/02 451/6
6,099,393 A * 8/2000 Katagiri ..... B24B 53/013 451/60
6,139,406 A * 10/2000 Kennedy ..... B24B 37/04 451/283
6,190,236 B1 * 2/2001 Drill ..... B24B 53/017 451/41
6,213,852 B1 * 4/2001 Fujii ..... B24B 57/02 451/446
6,283,840 B1 * 9/2001 Huey ..... B24B 57/02 451/288
6,284,092 B1 * 9/2001 Manfredi ..... B24B 57/02 451/446
6,336,850 B1 1/2002 Wada et al.
6,409,577 B1 * 6/2002 Robinson ..... B24B 37/04 438/692
6,458,020 B1 * 10/2002 Brigante ..... B24B 37/04 451/60
6,626,743 B1 * 9/2003 Boyd ..... B24B 21/04 451/299
6,669,538 B2 * 12/2003 Li ..... B24B 53/017 451/60
6,679,765 B2 * 1/2004 Tung ..... B24B 57/02 451/36
6,863,770 B2 * 3/2005 Jae ..... B24B 53/017 156/345.12
6,899,601 B2 * 5/2005 Boyd ..... B24B 21/04 451/299
7,452,264 B2 * 11/2008 Mavliev ..... B24B 53/017 451/72
8,845,395 B2 * 9/2014 Borucki ..... B24B 57/02 451/60
8,920,572 B2 * 12/2014 Chen ..... B24B 53/017 451/60
9,375,825 B2 * 6/2016 Sun ..... B24B 55/06
9,409,277 B2 * 8/2016 Umemoto ..... B24B 37/04
9,452,506 B2 * 9/2016 Butterfield ..... B24B 53/017
9,498,866 B2 * 11/2016 Lee ..... B24B 53/017
10,058,975 B2 * 8/2018 Brown ..... B24B 37/34
10,350,728 B2 * 7/2019 Diao ..... B24B 53/017
10,737,366 B2 * 8/2020 Lee ..... B24B 53/017
11,094,554 B2 * 8/2021 Lin ..... B24B 53/017
2002/0090896 A1 * 7/2002 Li ..... B24B 53/017 451/56
2002/0115379 A1 * 8/2002 Sevilla ..... B24B 57/02 451/6
2003/0068959 A1 4/2003 Kajiwara et al.
2003/0104769 A1 * 6/2003 Brunelli ..... B24B 53/017 451/28
2004/0162007 A1 * 8/2004 Phan ..... H01L 21/67051 451/36
2005/0107012 A1 * 5/2005 Jae ..... B24B 53/017 451/41
2005/0130566 A1 * 6/2005 Kajiwara ..... B24B 37/04 451/41
2005/0221724 A1 10/2005 Terada et al.
2013/0023186 A1 * 1/2013 Motoshima ..... B24B 49/14 451/36
2014/0213157 A1 * 7/2014 Torikoshi ..... B24B 53/007 451/72
2014/0273763 A1 * 9/2014 Lee ..... B24B 53/017 451/72
2014/0323017 A1 * 10/2014 Tang ..... B24B 53/017 451/444
2015/0314417 A1 * 11/2015 Sun ..... B24B 53/007 451/56
2016/0016283 A1 * 1/2016 Butterfield ..... B24B 53/017 156/345.12
2016/0114459 A1 * 4/2016 Butterfield ..... B24B 53/017 156/345.12
2016/0167195 A1 * 6/2016 Diao ..... B24B 37/04 216/53
2017/0232572 A1 * 8/2017 Brown ..... B24B 37/107 451/5
2017/0368663 A1 12/2017 Yang et al.
2017/0368664 A1 12/2017 Yang et al.
2019/0126430 A1 * 5/2019 Shinozaki ..... B24B 55/06

FOREIGN PATENT DOCUMENTS

JP H07-156063 A 6/1995
JP H09-131661 A 5/1997
JP H11-114811 A 4/1999
JP 2001-150345 A 6/2001
JP 2001237208 A * 8/2001 ..... B24B 53/017
JP 2007000968 A * 1/2007
JP 2007168039 A * 7/2007
JP 4054306 B 2/2008
JP 2008-194767 A 8/2008
JP 2013-099828 A 5/2013
JP 2013099828 A * 5/2013 ..... B24B 37/015
KR 20070035282 A * 3/2007
KR 20070112647 A * 11/2007
KR 20130010844 A * 1/2013
KR 20150011474 A * 2/2015
KR 102121738 B1 * 6/2020
WO WO 2017/222999 A1 12/2017

* cited by examiner

APPARATUS FOR POLISHING AND METHOD FOR POLISHING

TECHNICAL FIELD

The present invention relates to an apparatus for polishing and a method for polishing.

BACKGROUND ART

In a manufacturing process of a semiconductor device, a planarization technique for a semiconductor device surface is becoming more important. Chemical mechanical polishing (CMP) is known as the planarization technique. The chemical mechanical polishing is a technique for performing polishing using a polishing apparatus by bringing a substrate such as a semiconductor wafer into sliding contact with a polishing pad while supplying polishing liquid (slurry) including abrasive grains such as silica ($SiO_2$) or ceria ($CeO_2$) to the polishing pad.

A polishing apparatus that performs a CMP process includes a polishing table that supports a polishing pad and a substrate holding mechanism called top ring, polishing head, or the like for holding a substrate. The polishing apparatus supplies polishing liquid from a polishing liquid supply nozzle to the polishing pad and presses the substrate against the surface (a polishing surface) of the polishing pad with a predetermined pressure. At this time, the polishing table and the substrate holding mechanism are rotated, whereby the substrate comes into sliding contact with the polishing surface and the surface of the substrate is polished to be flat and a mirror surface.

A polishing rate of the substrate depends on not only a polishing load of the substrate on the polishing pad but also a surface temperature of the polishing pad. This is because chemical action of the polishing liquid on the substrate depends on temperature. Depending on a substrate to be manufactured, it is desired to execute the CMP process at a low temperature in order to prevent deterioration of quality. Therefore, in the polishing apparatus, it is important to keep the surface temperature of the polishing pad during the substrate polishing at an optimum value. Accordingly, in recent years, a polishing apparatus including a temperature adjusting mechanism that adjusts the surface temperature of the polishing pad has been proposed.

Meanwhile, polishing liquid used in a CMP apparatus is expensive. Cost is required for disposal of used polishing liquid. Therefore, a reduction in an amount of use of the polishing liquid is requested for reducing operation cost of the CMP apparatus and manufacturing cost of a semiconductor device. Also, it is requested to suppress or prevent the influence of the used polishing liquid and byproducts on the quality of the substrate and/or the polishing rate.

CITATION LIST

Patent Literature

Patent Literature 1: Japanese Patent Application Laid-Open No. 2001-150345

Patent Literature 2: Japanese Patent No. 4054306

Patent Literature 3: Japanese Patent Application Laid-Open No. 2008-194767

Patent Literature 4: United States Patent Publication No. 2016/0167195

SUMMARY OF INVENTION

Technical Problem

An example of slurry use amount reduction includes providing a housing including a recessed section opened to a side facing a polishing pad and a retainer in contact with the polishing pad around the recessed section (Patent Literature 1). In this configuration, a supply path of polishing liquid is provided in the housing to supply the polishing liquid into the recessed section. A thin layer of the polishing liquid is formed by delivering the polishing liquid from a narrow gap between the retainer and the polishing pad. Another example includes supplying polishing liquid to the outer side of a chamfered front edge of a distribution device and pressing the polishing liquid against a polishing pad in a chamfered portion of the front edge to thereby fill the polishing liquid in grooves of the polishing pad, and forming a thin layer of the polishing liquid with a rear edge of the distribution device (Patent Literature 2). In these slurry supplying methods, the configuration is relatively complicated, an effect of the use amount reduction is insufficient, and there is room of improvement.

As an example of removal of used polishing liquid, there is a cleaning device for a polishing apparatus in which a suction port coupled to a vacuum pipe and a cleaning nozzle coupled to a pressure water pipe are disposed close to each other side by side (Patent Literature 3). There is an apparatus in which fluid outlets are provided on width direction both sides of a main body of a spray system, a fluid inlet is provided between the fluid outlets on both the sides, and fluid is jetted onto a polishing surface from the fluid outlets on both the sides toward a fluid inlet direction and fluid including used polishing liquid is collected from the fluid inlet (Patent Literature 4). In these configurations, it is necessary to suck and collect jetted cleaning liquid together with the used polishing liquid, whereby a large suction force is required.

The present invention has been devised in view of the circumstances described above and an object of the present invention is to solve at least a part of the problems described above.

Solution To Problem

According to an aspect of the present invention, there is provided an apparatus for polishing an object to be polished using a polishing pad having a polishing surface, the apparatus including: a polishing table for supporting the polishing pad, the polishing table being configured to be rotatable; a substrate holding unit configured to hold the object to be polished and press the object to be polished against the polishing pad; a supplying device configured to supply polishing liquid to the polishing surface in a state in which the supplying device is pressed against the polishing pad; and a pressing mechanism configured to press the supplying device against the polishing pad. The supplying device includes a sidewall pressed against the polishing surface, the sidewall including a first wall on an upstream side in a rotating direction of the polishing table and a second wall on a downstream side in the rotating direction of the polishing table, and a holding space (retaining space) surrounded by the sidewall and opened to the polishing surface, the holding space configured to hold or retain the polishing liquid and supplying the polishing liquid to the polishing surface. The pressing mechanism is capable of respectively adjusting pressing forces to the first wall and the second wall.

According to an aspect of the present invention, there is provided an apparatus for polishing an object to be polished using a polishing pad having a polishing surface, the apparatus including: a polishing table for supporting the polishing pad, the polishing table being configured to be rotatable; a substrate holding unit configured to hold the an object to be polished and pressing the object to be polished against the polishing pad; and a polishing-liquid removing unit configured to remove the polishing liquid from the polishing surface. The polishing-liquid removing unit includes a cleaning unit configured to jet cleaning liquid onto the polishing surface and a sucking unit configured to suck the polishing liquid on the polishing surface onto which the cleaning liquid is jetted. The cleaning unit includes a cleaning space surrounded by a sidewall. The sidewall includes an opening section for opening the cleaning space toward a radial direction outer side of the polishing table.

DESCRIPTION OF EMBODIMENTS

Figure 1:
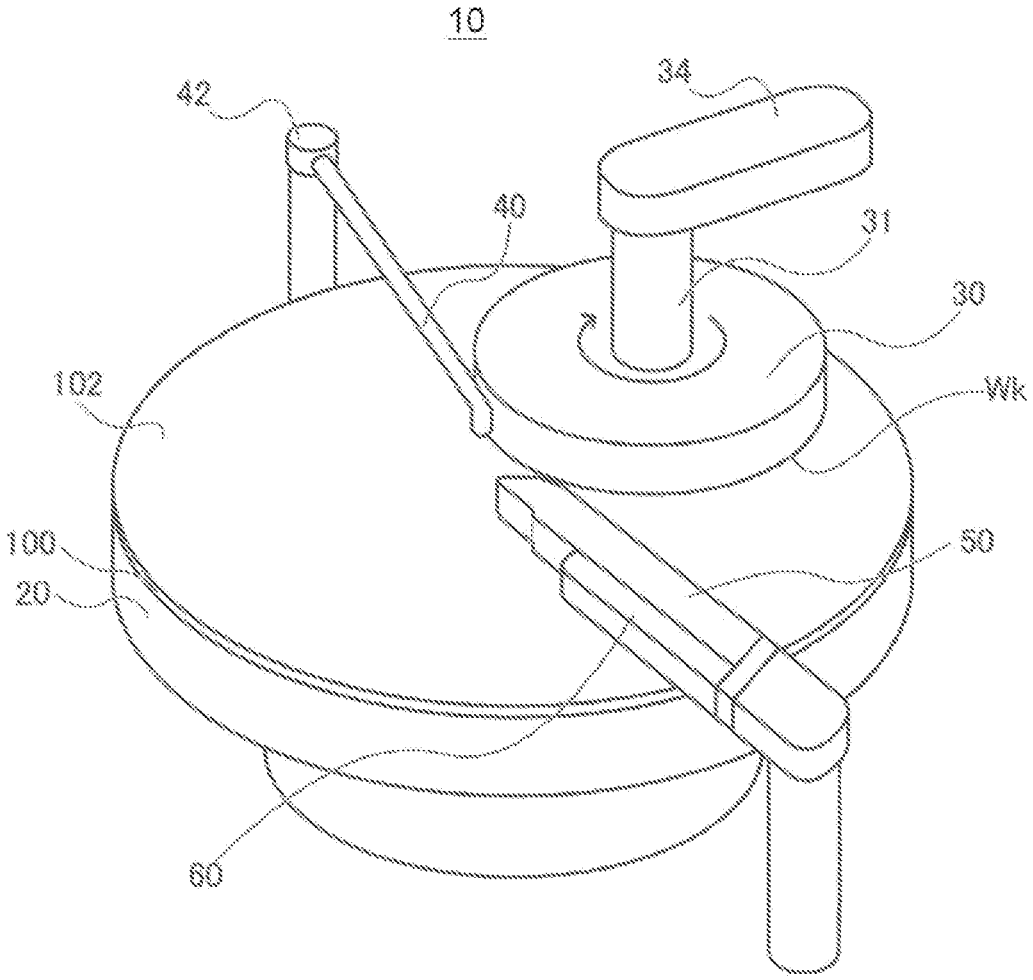
FIG. 1 is a diagram showing a configuration overview of a polishing apparatus according to an embodiment of the present invention.

Embodiments of the present invention are explained below with reference to the drawings. In the drawings, same or equivalent components are denoted by the same reference numerals or signs and redundant explanation of the components is omitted.

First Embodiment

FIG. 1 is diagram showing a configuration overview of a polishing apparatus according to an embodiment of the present invention. A polishing apparatus 10 according to this embodiment is configured to be able to perform polishing of a substrate Wk such as a semiconductor wafer serving as an object to be polished (polishing object) using a polishing pad 100 having a polishing surface 102. As shown in FIG. 1, the polishing apparatus 10 includes a polishing table 20 that supports the polishing pad 100 and a top ring (a substrate holding unit) 30 that holds the substrate Wk and presses the substrate Wk against the polishing pad 100. Further, the polishing apparatus 10 includes a polishing-liquid supply nozzle (a polishing-liquid supplying unit) 40 that supplies polishing liquid (slurry) to the polishing pad 100.

The polishing table 20 is formed in a disk shape and configured to be rotatable with a center axis thereof as a rotation axis. The polishing pad 100 is attached to the polishing table 20 by pasting or the like. The surface of the polishing pad 100 forms the polishing surface 102. The polishing table 20 is rotated by a not-shown motor, whereby the polishing pad 100 rotates integrally with the polishing table 20.

The top ring 30 holds, on the lower surface thereof, the substrate Wk serving as the object to be polished with vacuum suction or the like. The top ring 30 is configured to be rotatable together with the substrate Wk with power from a not-shown motor. An upper part of the top ring 30 is connected to a supporting arm 34 via a shaft 31. The top ring 30 is movable in the up-down direction with a not-shown air cylinder and is capable of adjusting the distance to the polishing table 20. Consequently, the top ring 30 can press the held substrate Wk against the surface (the polishing surface) 102 of the polishing pad 100. Further, the supporting arm 34 is configured to be swingable by a not-shown motor. The supporting arm 34 moves the top ring 30 in a direction parallel to the polishing surface 102. In this embodiment, the top ring 30 is configured to be movable to a not-shown receiving position of the substrate Wk and a position above the polishing pad 100, and is configured to be capable of changing a pressing position of the substrate Wk against the polishing pad 100. In the following explanation, a pressing position (a holding position) of the substrate Wk by the top ring 30 is referred to as "polishing region" as well.

The polishing-liquid supply nozzle 40 is provided above the polishing table 20 and supplies the polishing liquid (the slurry) to the polishing pad 100 supported by the polishing table 20. The polishing-liquid supply nozzle 40 is supported by a shaft 42. The shaft 42 is configured to be swingable by a not-shown motor. The polishing-liquid supply nozzle 40 can change a dripping position of the polishing liquid during polishing.

The polishing apparatus 10 also includes a control unit 70 (see FIG. 4) that controls the overall operation of the polishing apparatus 10. The control unit 70 includes a CPU and a memory. The control unit 70 may be configured as a microcomputer that realizes a desired function using software, may be configured as a hardware circuit that performs dedicated arithmetic processing, or may be configured by a combination of the microcomputer and the hardware circuit that performs the dedicated arithmetic processing.

In the polishing apparatus 10, polishing of the substrate Wk is performed as explained below. First, the top ring 30 that holds the substrate Wk on the lower surface is rotated and the polishing pad 100 is rotated. In this state, the polishing liquid is supplied from the polishing-liquid supply nozzle 40 to the polishing surface 102 of the polishing pad 100. The substrate Wk held by the top ring 30 is pressed against the polishing surface 102. Consequently, the substrate Wk and the polishing pad 100 relatively move in a state in which the surface of the substrate Wk is in contact with the polishing pad 100 under the presence of the slurry. The substrate Wk is polished in this way.

Figure 2:
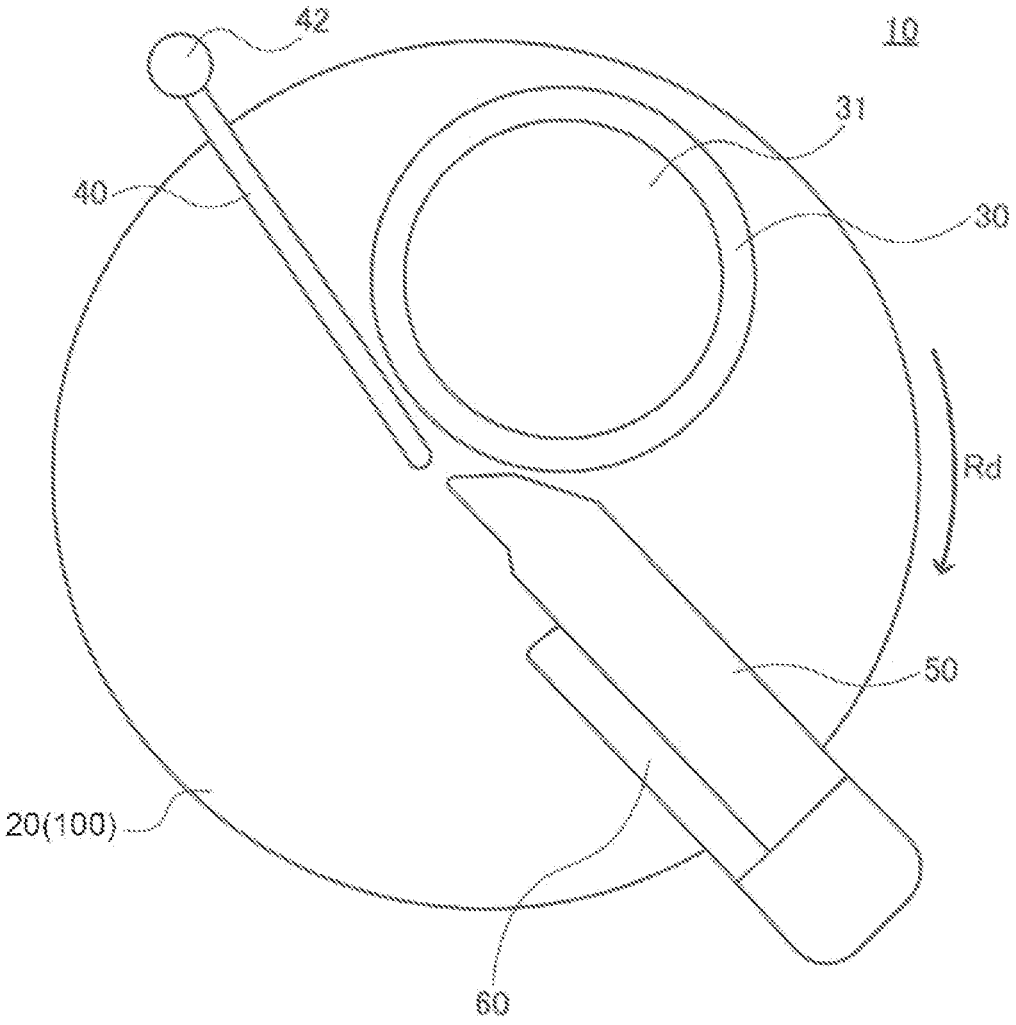
FIG. 2 is a plan view showing a disposition relation among components of the polishing apparatus.

The polishing apparatus 10 further includes a polishing-liquid removing unit 50 and a temperature adjusting unit 60 as shown in FIG. 1. FIG. 2 is a plan view showing a disposition relation among components of the polishing apparatus 10. As shown in FIG. 2, in the polishing apparatus 10 in this embodiment, the polishing-liquid supply nozzle 40, a polishing region of the substrate Wk (a pressing position of the substrate Wk by the top ring 30), the polishing-liquid removing unit 50, and the temperature adjusting unit 60 are disposed in this order in a rotating direction Rd of the polishing table 20 when the polishing of the substrate Wk is performed. In this embodiment, the polishing-liquid removing unit 50 and the temperature adjusting unit 60 are provided adjacent to each other. However, the polishing-liquid removing unit 50 and the temperature adjusting unit 60 may be provided to be separated without being limited to such an example.

The polishing-liquid removing unit 50 is provided in order to remove the polishing liquid from the polishing surface 102 further in the rear (on a downstream side) in the rotating direction Rd of the polishing table 20 than the polishing region of the substrate Wk. In other words, the polishing-liquid removing unit 50 removes, from the polishing surface 102, the polishing liquid used once for the polishing of the substrate Wk. As shown in FIG. 2, the polishing-liquid removing unit 50 is disposed to extend along the radial direction of the polishing table 20.

Figure 3:
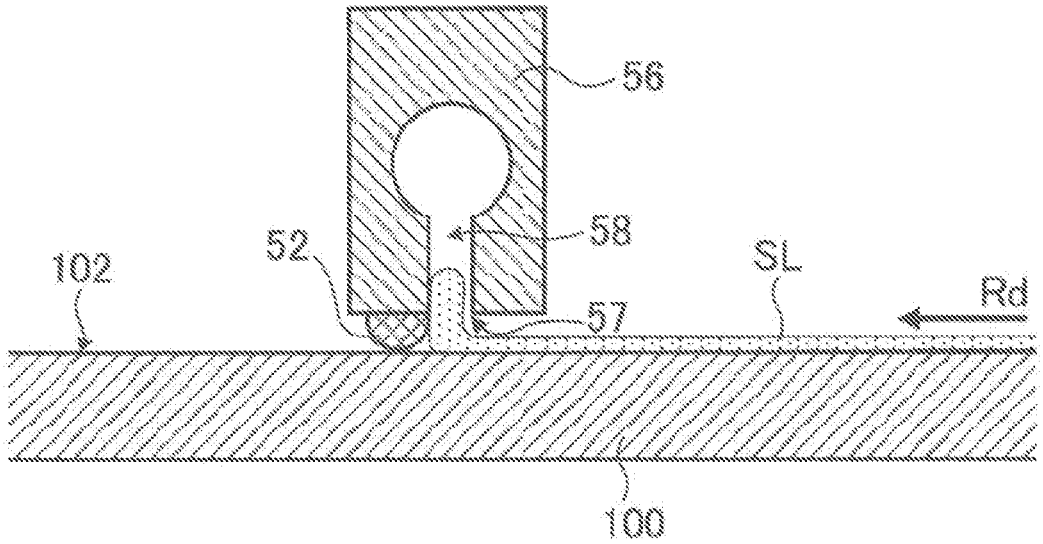
FIG. 3 is a diagram schematically showing an example of a polishing-liquid removing unit.

FIG. 3 is a diagram schematically showing an example of the polishing-liquid removing unit 50. In FIG. 3, a cross section perpendicular to the longitudinal direction of the polishing-liquid removing unit 50 (the radial direction of the polishing table 20) is shown. As shown in FIG. 3, the polishing-liquid removing unit 50 in this embodiment includes a damming unit 52 that dams polishing liquid SL on the polishing surface 102 and a sucking unit 56 that sucks the polishing liquid SL. In this embodiment, the damming unit 52 and the sucking unit 56 are integrally configured.

The damming unit 52 comes into contact with the polishing surface 102 and prevents the polishing liquid SL from moving in the rotating direction Rd of the polishing table 20. The material of the damming unit 52 is desirably selected such that the damming unit 52 does not scratch the polishing surface 102 and chips of the damming unit 52 itself due to the contact with the polishing surface 102 do not remain on the polishing surface 102. As an example, the damming unit 52 may be made of the same material as the material of a not-shown retainer ring that holds the outer circumferential edge of the substrate Wk or may be made of synthetic resin such as PPS (polyphenylene sulfide) or metal such as stainless steel. Resin coating of PEEK (polyether ketone), PTFE (polytetrafluoroethylene), or polyvinyl chloride may be applied to the surface of the damming unit 52. Further, as shown in FIG. 3, in the damming unit 52, a part in contact with the polishing surface 102 may be round-chamfered (or square-chamfered) such that contact resistance of the polishing surface 102 decreases.

The sucking unit 56 is disposed adjacent to the front (an upstream side) of the damming unit 52 in the rotating direction Rd of the polishing table 20. The sucking unit 56 includes a slit 57 opened toward the polishing surface 102. A not-shown vacuum source is connected to the slit 57 via a channel 58. In this embodiment, the channel 58 extending from the slit 57 to the not-shown vacuum source forms an angle of 90 degrees with respect to the polishing surface 102. The slit 57 is desirably formed shorter than the length of the damming unit 52 and longer than the diameter of the substrate Wk in the longitudinal direction of the polishing-liquid removing unit 50. Width Sw of the slit 57 may be decided based on a type of the polishing liquid SL, performance of the not-shown vacuum source, and the like. As an example, when the diameter of the substrate Wk is 300 mm, the length in the longitudinal direction of the slit 57 is desirably 300 mm or more and the width Sw is desirably approximately 1 mm to 2 mm.

In this way, in the polishing-liquid removing unit 50 in this embodiment, in the rotating direction Rd of the polishing table 20, the damming unit 52 that dams the polishing liquid SL is disposed continuously behind the sucking unit 56 that sucks the polishing liquid SL. Therefore, the polishing liquid SL dammed by the damming unit 52 can be sucked by the sucking unit 56. The polishing liquid SL can be suitably removed from the polishing surface 102.

The polishing-liquid removing unit 50 is desirably separated from the polishing surface 102 when the polishing surface 102 is conditioned by a not-shown atomizer or dresser. In other words, the polishing-liquid removing unit 50 may be configured to be movable to a polishing liquid removing position for removing the polishing liquid SL and a standby position apart from the polishing surface 102, and may be located in the standby position when the conditioning of the polishing surface 102 is performed. The polishing apparatus 10 in this embodiment can perform the conditioning of the polishing surface 102 in a state in which the polishing liquid is removed from the polishing surface 102 by the polishing-liquid removing unit 50. Accordingly, liquid used by the atomizer or the dresser and the polishing liquid can be prevented from mixing. Therefore, it is possible to respectively collect used liquid caused by the polishing and the conditioning of the substrate Wk. It is possible to contribute to environment preservation.

Figure 4:
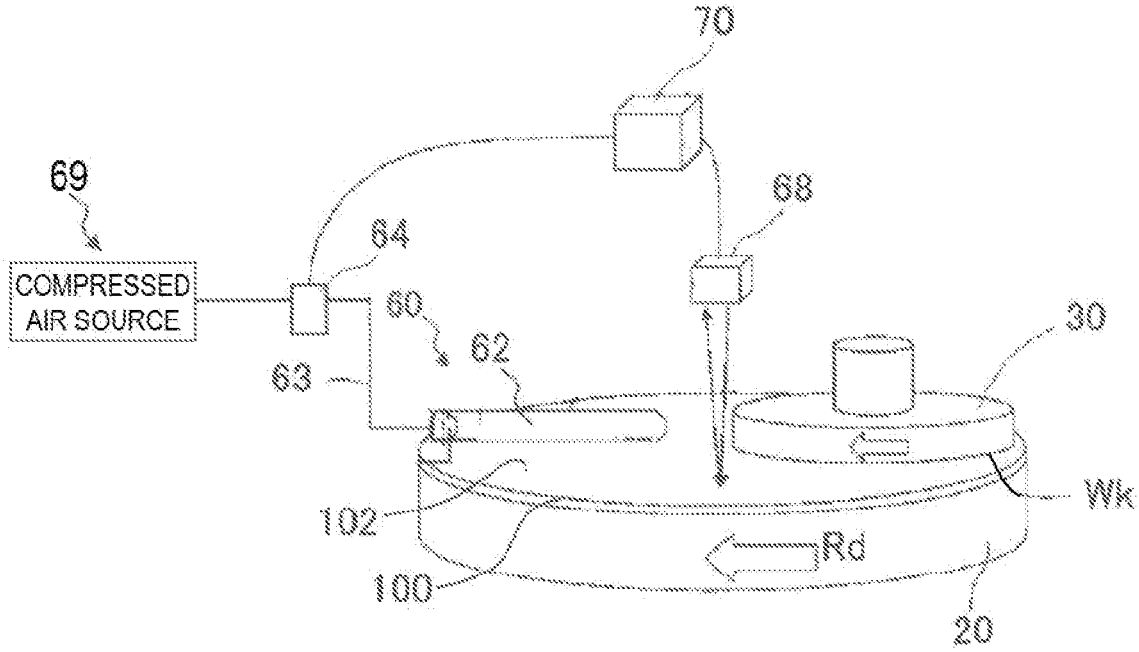
FIG. 4 is a diagram for explaining control of a temperature adjusting unit by a control unit.

Referring back to FIGS. 1 and 2, the temperature adjusting unit 60 is disposed behind the polishing-liquid removing unit 50 in the rotating direction Rd of the polishing table 20. The temperature adjusting unit 60 is controlled by the control unit to adjust the temperature of the polishing surface 102. FIG. 4 is a diagram for explaining the control of the temperature adjusting unit 60 by the control unit. In FIG. 4, illustration of the polishing-liquid removing unit 50 is omitted. As shown in FIG. 4, the temperature adjusting unit 60 in this embodiment includes a gas jetting nozzle (an injector) 62 for spraying gas to the polishing surface 102. The gas jetting nozzle 62 is connected to a compressed air source 69 via a compressed air supply line 63. A pressure control valve 64 is provided in the compressed air supply line 63. Compressed air supplied from the compressed air source 69 passes through the pressure control valve 64, whereby pressure and a flow rate are controlled. The pressure control valve 64 is connected to the control unit 70. The compressed air may have a normal temperature or may be cooled or heated to a predetermined temperature.

As shown in FIG. 4, a temperature sensor 68 that detects the surface temperature of the polishing pad 100 is set above the polishing pad 100. It is desirable that the temperature sensor 68 is provided behind the polishing-liquid removing unit 50 in the rotating direction Rd of the polishing table 20 and detects the temperature of the polishing surface 102 in a state in which the polishing liquid is removed. The temperature sensor 68 is connected to the control unit 70. The control unit 70 adjusts a valve opening degree of the pressure control valve 64 with PID control according to a difference between a target temperature, which is a predetermined temperature or an input setting temperature, and an actual temperature of the polishing surface 102 detected by the temperature sensor 68, and controls a flow rate of the compressed air jetted from the gas jetting nozzle 62. Consequently, the compressed air having an optimum flow rate is blown against the polishing surface 102 of the polishing pad 100 from the gas jetting nozzle 62. The temperature of the polishing surface 102 is maintained at the target temperature.

Figure 5:
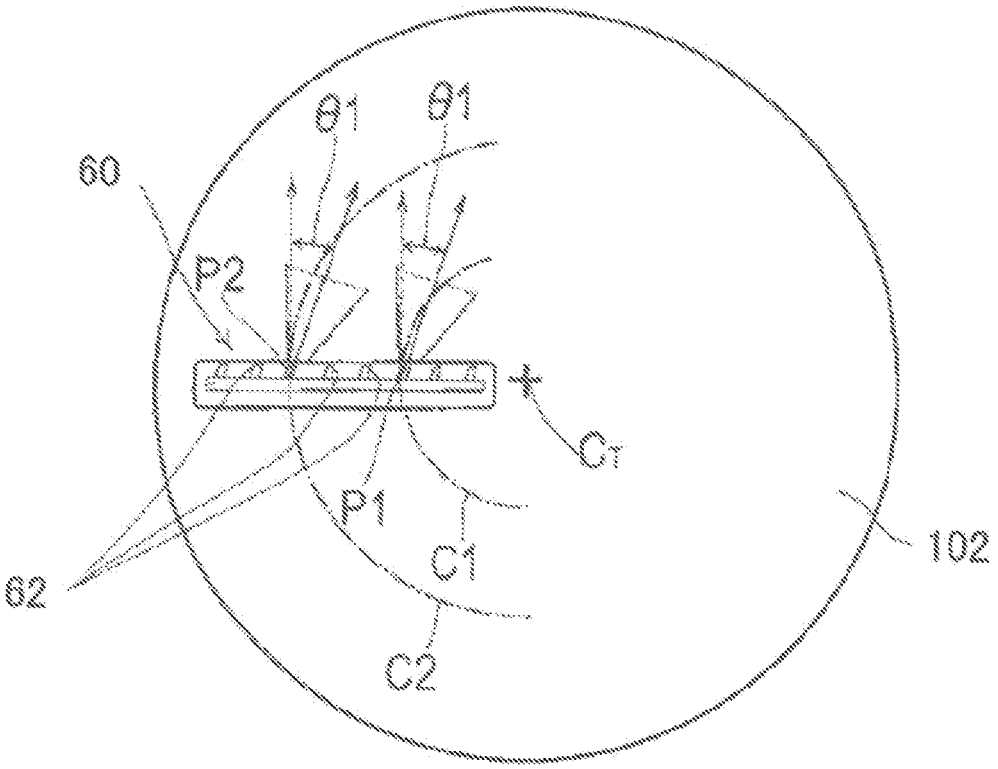
FIG. 5 is a plan view schematically showing a gas jetting nozzle of the temperature adjusting unit and a polishing pad.
Figure 6:
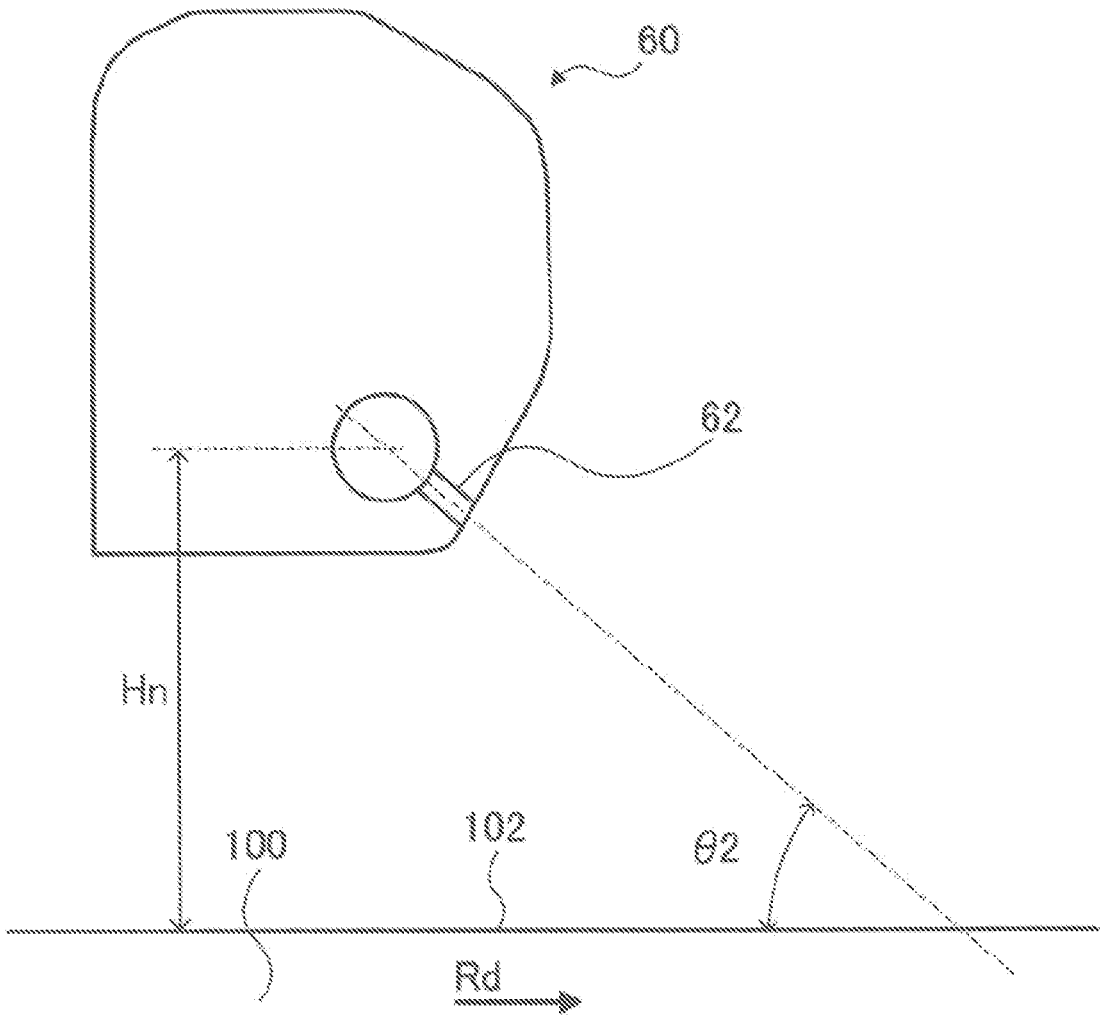
FIG. 6 is a side view schematically showing the gas jetting nozzle of the temperature adjusting unit and the polishing pad.

FIGS. 5 and 6 are a plan view and a side view schematically showing the gas jetting nozzle 62 of the temperature adjusting unit 60 and the polishing pad 100. As shown in FIG. 5, the temperature adjusting unit 60 includes a plurality of gas jetting nozzles 62 disposed at every predetermined interval along the radial direction of the polishing table 20 (eight nozzles are attached in an example shown in FIG. 5). In FIG. 5, the polishing pad 100 rotates in the clockwise direction Rd around a rotation center CT during polishing. The nozzles are numbered in ascending order of 1, 2, 3, . . . , and 8 from the pad inner side. For example, third and sixth two gas jetting nozzles 62 are explained as an example. When concentric circles C1 and C2 passing points P1 and P2 immediately below the third and sixth two gas jetting nozzles 62 and centering on CT are drawn and a tangential direction at the points P1 and P2 on the concentric circles C1 and C2 is defined as a rotation tangential direction of the polishing pad 100, a gas jetting direction of the gas jetting nozzles 62 is tilted by a predetermined angle (θ1) to the pad center side with respect to the rotation tangential direction of the polishing pad. The gas jetting direction means a direction of the center line of an angle (a gas jetting angle) at which the gas spreads in a fan shape from gas jetting nozzle ports. The nozzles other than the third and sixth nozzles are also tilted by the predetermined angle (θ1) to the pad center side with respect to the rotation tangential direction of the polishing pad. The angle (θ1) in the gas jetting direction of the gas jetting nozzles 62 with respect to the rotation tangential direction of the polishing pad is set to 15° to 35° in a relation with a temperature adjusting ability. In the above explanation, there are the eight nozzles. However, the number of nozzles can be adjusted by closing nozzle holes with plugs or the like and can be set to any number. The number of nozzles is selected as appropriate according to, for example, the size of the polishing pad 100.

As shown in FIG. 6, the gas jetting direction of the gas jetting nozzle 62 is not perpendicular to the surface (the polishing surface) 102 of the polishing pad 100 and is tilted by a predetermined angle to the rotating direction Rd side of the polishing table 20. When the angle in the gas jetting direction of the gas jetting nozzle 62 with respect to the polishing surface 102, that is, an angle formed by the polishing surface 102 and the gas jetting direction of the gas jetting nozzle 62 is defined as a gas entry angle (θ2), the gas entry angle (θ2) is set to 30° to 50° in a relation with a temperature adjusting ability. The gas jetting direction means a direction of the center line of an angle (a gas jetting angle) at which the gas spreads in a fan shape from gas jetting nozzle ports. As shown in FIG. 6, the gas jetting nozzle 62 is configured to be movable up and down. Height Hn from the polishing surface 102 of the gas jetting nozzle 62 can be adjusted.

The temperature of the polishing surface 102 can be adjusted by the temperature adjusting unit 60 by jetting the gas from at least one gas jetting nozzle 62 toward the polishing pad 100 (the polishing surface 102) during the polishing of the substrate Wk. Moreover, the polishing-liquid removing unit 50 that removes the polishing liquid from the polishing surface 102 is provided in the front of the temperature adjusting unit 60 in the rotating direction Rd of the polishing table 20. Therefore, the temperature adjusting unit 60 can adjust the temperature of the polishing surface 102 in a state in which the polishing liquid, which could be a heat insulating layer, is removed. Efficiency of the temperature adjustment of the polishing surface 102 can be improved. Even when the gas is powerfully jetted onto the polishing surface 102 from the gas jetting nozzle 62 of the temperature adjusting unit 60, the polishing liquid is suppressed from scattering and occurrence of scratches of the substrate Wk can be suppressed. Further, in the polishing apparatus 10 in this embodiment, the polishing liquid once used for the polishing of the substrate Wk is removed by the polishing-liquid removing unit 50. New polishing liquid is supplied from the polishing-liquid supply nozzle 40 to the polishing surface 102 every time. Therefore, it is possible to keep the quality of the polishing liquid used for the polishing of the substrate Wk constant.

(Modification 1)

Figure 7:
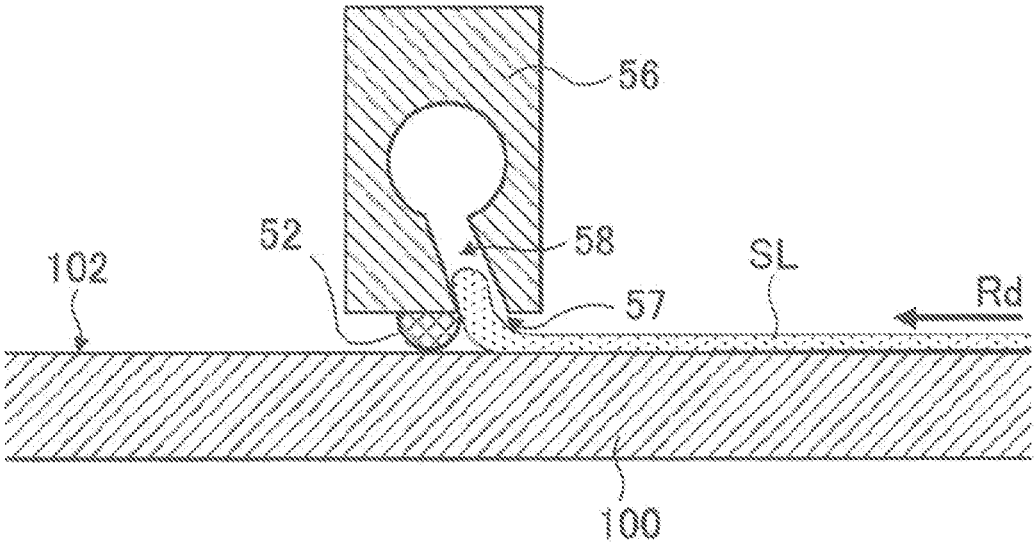
FIG. 7 is a diagram schematically showing an example of a polishing-liquid removing unit in a modification.

FIG. 7 is a diagram schematically showing an example of a polishing-liquid removing unit in a modification. In the embodiment explained above, the slit 57 and the channel 58 of the sucking unit 56 are provided at 90 degrees with respect to the polishing surface 102. However, without being limited to such an example, as shown in FIG. 7, the slit 57 and the channel 58 of the sucking unit 56 may be inclined such that an angle formed with the rotating direction Rd of the polishing table 20 is 10 degrees or more and less than 90 degrees. Consequently, it is possible to guide the polishing liquid SL to the channel 58 according to the rotation of the polishing table 20 and suitably suck the polishing liquid SL.

In the embodiment explained above, the damming unit 52 of the sucking unit 56 comes into contact with the polishing surface 102. However, without being limited by such an example, the damming unit 52 only has to be in contact with the polishing liquid and may be provided to have a gap between the damming unit 52 and the polishing surface 102. In this case, since the damming unit 52 and the polishing surface 102 do not come into contact, it is possible to prevent chips of the damming unit 52 from being formed and prevent contact resistance from occurring. The polishing apparatus 10 may further include a sensor that detects the position of the polishing surface 102 or the distance between the polishing-liquid removing unit 50 and the polishing surface 102. The polishing apparatus 10 may bring the polishing-liquid removing unit 50 into contact with the polishing surface 102 based on the detected position or distance, or may keep the distance between the polishing-liquid removing unit 50 and the polishing surface 102 constant.

Further, in the embodiment explained above, the polishing-liquid removing unit 50 integrally includes the damming unit 52 and the sucking unit 56. However, without being limited to such an example, the polishing-liquid removing unit 50 may separately include the damming unit 52 and the sucking unit 56, or may include only one of the damming unit 52 and the sucking unit 56. At least part of the polishing-liquid removing unit 50 may be provided in an integral manner with the dresser, the atomizer, or the like for conditioning the polishing pad 100.

(Modification 2)

Figure 8:
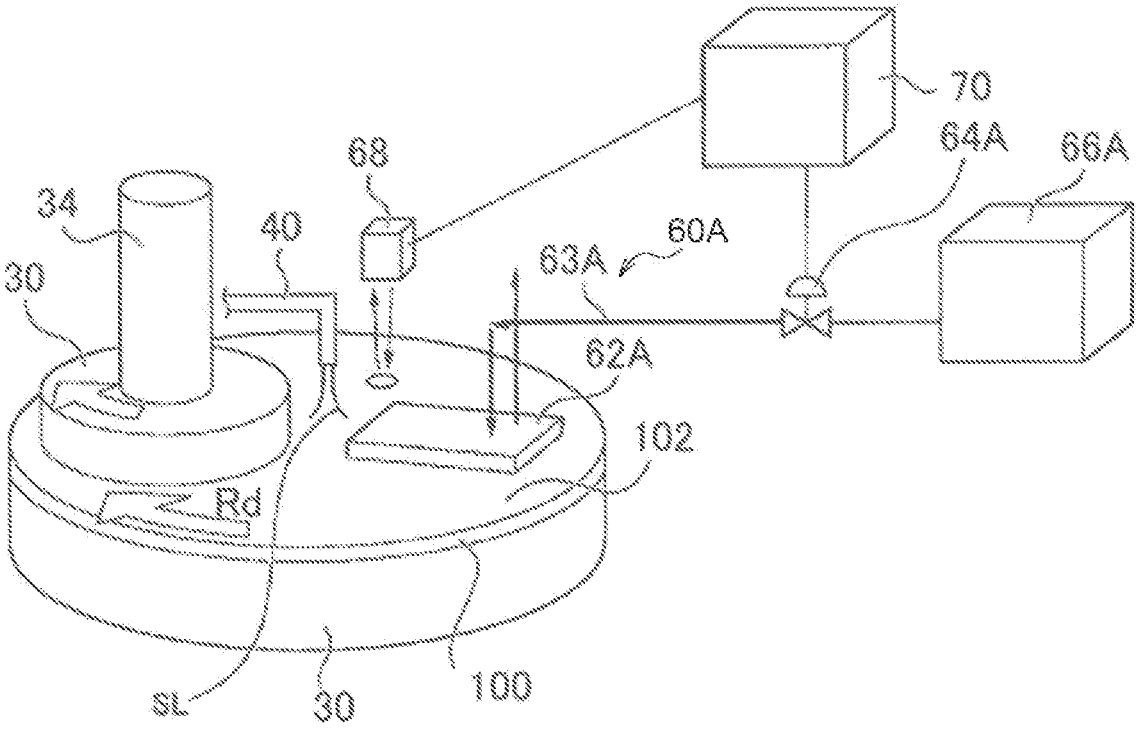
FIG. 8 is a diagram for explaining control of a temperature adjusting unit in the modification by the control unit.

FIG. 8 is a diagram for explaining control of a temperature adjusting unit 60A in a modification by the control unit. The temperature adjusting unit 60 in the embodiment explained above includes the gas jetting nozzle (the injector) 62 that jets the gas toward the polishing surface 102. However, the temperature adjusting unit 60 may include a heat exchanger, on the inside of which fluid flows, instead of or in addition to the gas jetting nozzle (the injector) 62. As shown in FIG. 8, the temperature adjusting unit 60A in the modification includes a heat exchanger 62A instead of the gas jetting nozzle 62. The modification shown in FIG. 8 is the same as the polishing apparatus 10 in the embodiment except the temperature adjusting unit 60A. In FIG. 8, illustration of the polishing-liquid removing unit 50 is omitted. As shown in FIG. 8, a not-shown channel is formed on the inside of the heat exchanger 62A. The heat exchanger 62A is connected to a fluid supply source 66A via a pipe 63A. A pressure control valve 64A is provided in the pipe 63A. Fluid supplied from the fluid supply source 66A passes through the pressure control valve 64A, whereby pressure and a flow rate of the fluid are controlled. The pressure control valve 64A is connected to the control unit 70. As the fluid used in the heat exchanger 62A, liquid such as water may be used or gas such as air may be used. Reaction gas may be fed into the inside of the heat exchanger 62A, and a catalyst for facilitating heat generation reaction of the reaction gas may be provided on the inside of the heat exchanger 62A. Further, the heat exchanger 62A may be disposed in contact with the polishing surface 102 or may be disposed to have a gap between the heat exchanger 62A and the polishing surface 102.

As in the embodiment explained above, the control unit 70 adjusts a valve opening degree of the pressure control valve 64A based on temperature detected by the temperature sensor 68 and controls a flow rate of fluid flowing to the inside of the heat exchanger 62A. With such a temperature adjusting unit 60A in the modification, as in the embodiment explained above, it is possible to adjust the temperature of the polishing surface 102. Moreover, the polishing-liquid removing unit 50 is provided in the front of the temperature adjusting unit 60A in the rotating direction Rd of the polishing table 20. Therefore, in the polishing apparatus in the modification, temperature adjustment of the polishing surface 102 by the temperature adjusting unit 60A can be performed in a state in which the polishing liquid, which could be a heat insulating layer, is removed. It is possible to improve efficiency of the temperature adjustment of the polishing surface 102.

Second Embodiment

Figure 9:
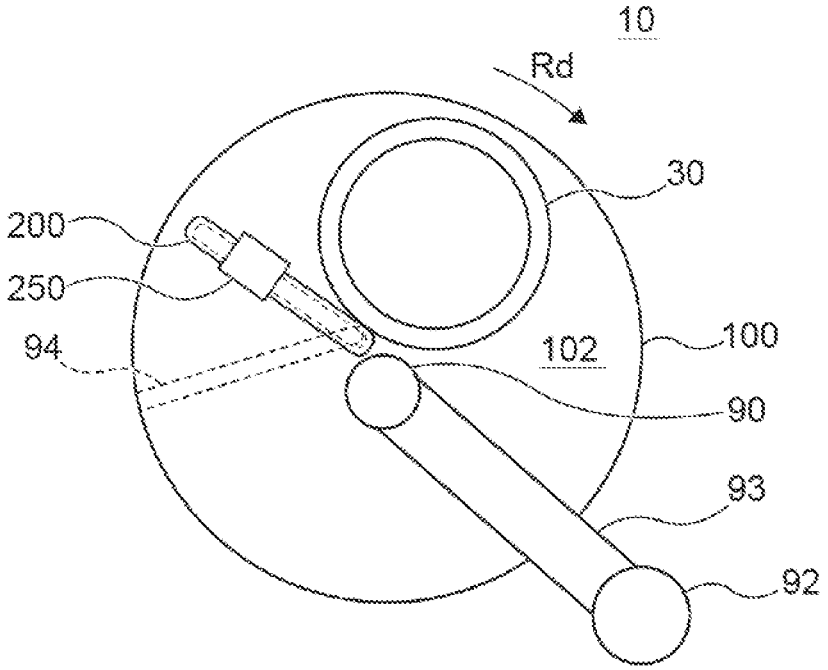
FIG. 9 is a plan view showing a disposition relation among components of a polishing apparatus according to a second embodiment.

FIG. 9 is a plan view showing a disposition relation among components of the polishing apparatus 10 according to a second embodiment. In the following explanation, the same components as the components in the embodiment explained above are denoted by the same reference numerals or sigs and detailed explanation of such components is omitted. In this embodiment, the polishing apparatus 10 includes a supplying device (a slurry pad) 200 for supplying polishing liquid to the polishing pad 100. The supplying device 200 has a shape of a pad or a box. The supplying device 200 is pressed against the polishing surface 102 of the polishing pad 100 by a pressing mechanism 250 explained below. A dresser 90 and an atomizer 94 are also shown in FIG. 9. The dresser 90 is connected to a shaft 92 via an arm 93. The shaft 92 is configured to be swingable by a not-shown motor. The shaft 92 is capable of moving the dresser 90 on the polishing pad 100 and capable of moving the dresser 90 to a standby position outside the polishing pad 100. The dresser 90 is configured to be movable up and down by a not-shown lifting and lowering mechanism and configured to be pressed against the polishing pad 100. The atomizer 94 is configured to be capable of supplying pure water (DIW) to the polishing surface of the polishing pad 100. The dresser 90 and the atomizer 94 can be omitted.

Figure 10:
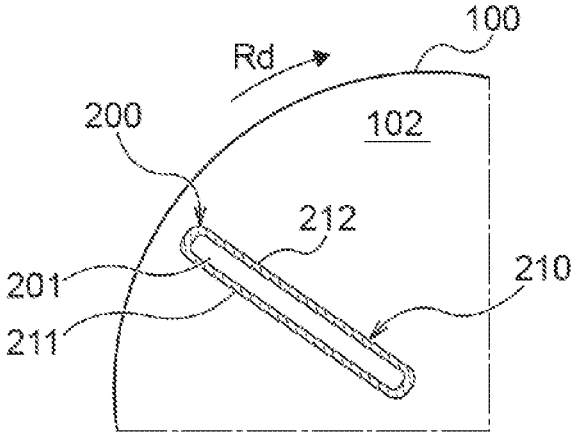
FIG. 10 is a plan view showing a schematic shape of a supplying device.
Figure 11:
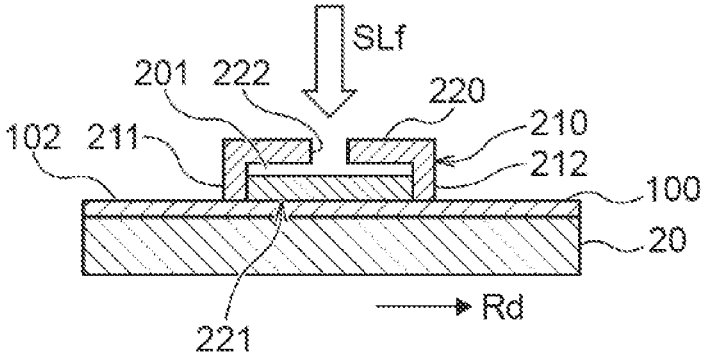
FIG. 11 is a sectional view showing the schematic shape of the supplying device.

FIG. 10 is a plan view showing a schematic shape of the supplying device 200. FIG. 11 is a sectional view showing the schematic shape of the supplying device 200. The supplying device 200 has an elongated shape in a plan view and includes, on the inside thereof, a holding space 201 surrounded by a sidewall 210. The length of the supplying device 200 is generally formed the same as the diameter of the substrate Wk held by the top ring 30. Like the damming unit 52 explained above, as the material of the sidewall 210 of the supplying device 200, the same material as the material of the damming unit 52 is desirably selected such that the polishing surface 102 is not scratched and chips of the sidewall 210 itself due to contact with the polishing surface 102 do not remain on the polishing surface 102.

The sidewall 210 includes a sidewall 211 located on an upstream side in the rotating direction Rd of the polishing table 20 and a sidewall 212 located on a downstream side in the rotating direction Rd. A side of the supplying device 200 facing the polishing surface 102 of the polishing pad 100 is opened (an opening section 221). In other words, the holding space 201 is opened on or to the polishing surface 102. An upper part of the supplying device 200 is closed by a top plate 220 integral with or separate from the sidewall 210. When the top plate 220 is separate, the top plate 220 can be configured as a top cover attachable to the sidewall 210. One or a plurality of introducing sections 222 for introducing polishing liquid are provided in the top plate 220. Polishing liquid (slurry) SLf is supplied from the polishing-liquid supply nozzle 40 to the holding space 201 in the supplying device 200 via the introducing section(s) 222. When the plurality of introducing sections 222 are present, the polishing-liquid supply nozzle 40 includes a plurality of nozzle tips branching according to the number of the introducing sections 222. In the following explanation, the polishing liquid before being used for polishing treatment is sometimes described as SLf and the polishing liquid after being used for the polishing treatment is sometimes described as SLu.

Figure 12:
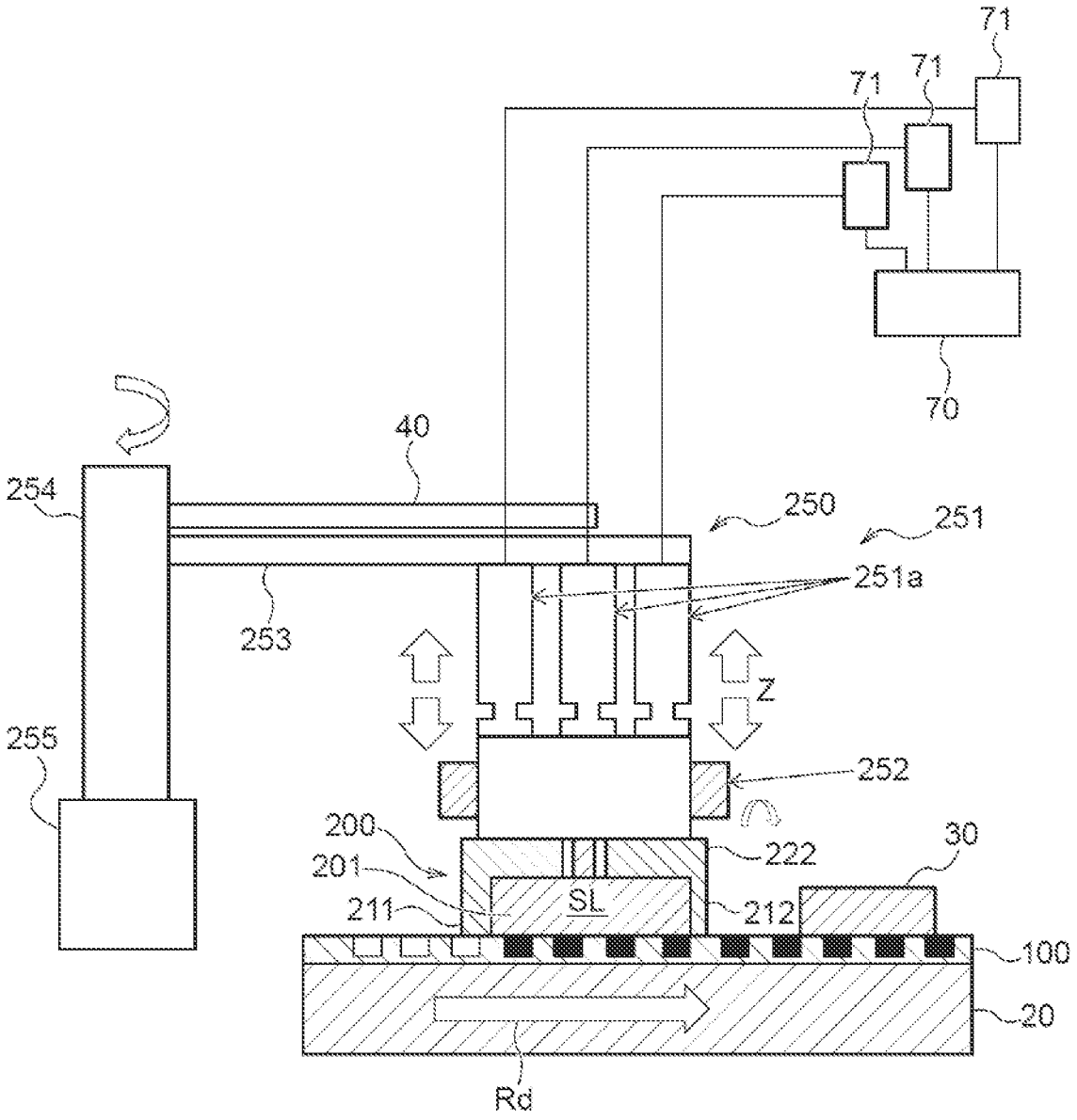
FIG. 12 is a sectional view showing the supplying device and a pressing mechanism.

FIG. 12 is a sectional view showing the supplying device 200 and the pressing mechanism 250. The pressing mechanism 250 is disposed above the supplying device 200 and includes a cylinder device 251 and a pressing-posture adjusting mechanism 252. The pressing mechanism 250 is connected to a shaft 254 via an arm 253. The shaft 254 is configured to be swingable by a motor 255. The pressing mechanism 250 is swingable by rotation of the shaft 254. Instead of separately providing the shaft 254, the pressing mechanism 250 may be connected to the shaft 42 of the polishing-liquid supply nozzle 40 via the arm 253. The tip of the polishing-liquid supply nozzle 40 is connected to the introducing sections 222 of the supplying device 200. The polishing liquid SL is supplied from the polishing-liquid supply nozzle 40.

Figure 13A:
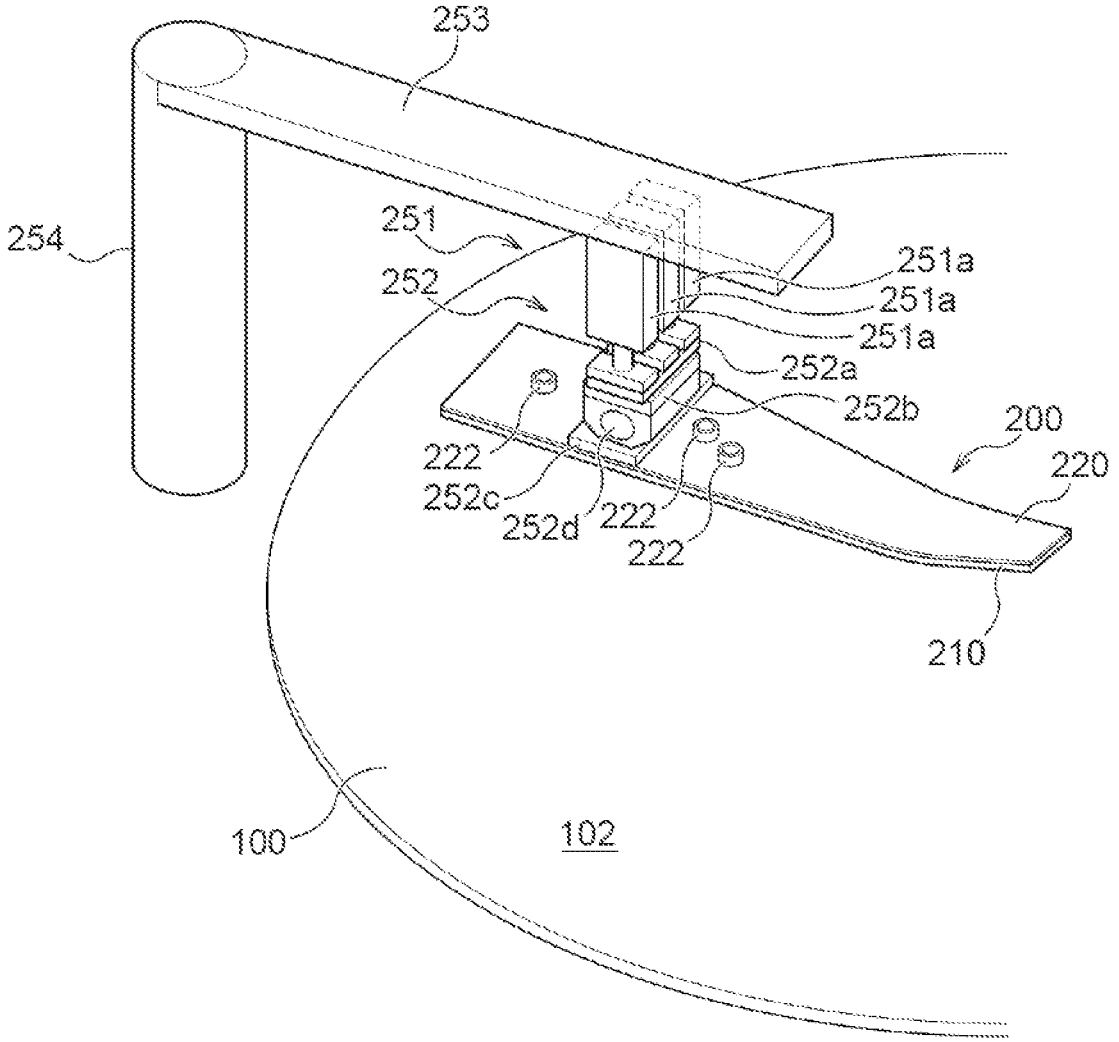
FIG. 13A is a perspective view showing a configuration example of the pressing mechanism.

The cylinder device 251 can include a plurality of cylinders 251*a* along the longitudinal direction of the supplying device 200 and/or the width direction of the supplying device 200 (the polishing table rotating direction Rd). The cylinders include rods driven by fluid (gas or liquid). In this embodiment, as shown in FIG. 13A, the cylinder device 251 is configured such that three cylinders 251*a* are disposed side by side along the width direction of the supplying device 200. The cylinders 251*a* are connected to a fluid supply source (not shown in FIG. 13A) via electric pneumatic regulators (proportional control valves) 71. The electric pneumatic regulators 71 are connected to the control unit 70. The control unit 70 controls the electric pneumatic regulators 71, whereby pressure and a flow rate of driving fluid supplied from the not-shown fluid supply source to the cylinders 251*a* are controlled. Pressing forces of the cylinders 251*a* are adjusted. The pressing forces of the cylinders 251*a* are adjusted, whereby a pressing force of the sidewall 211 on the upstream side being pressed against the polishing surface 102 is adjusted and a pressing force of the sidewall 212 on the downstream side being pressed against polishing surface 102 is adjusted. The pressing force to the sidewall 211 and the pressing fore to the sidewall 212 can be respectively separately adjusted (to be the same or different). An example is explained in which the three cylinders 251*a* disposed side by side in the width direction of the supplying device 200 are provided. However, two or four or more cylinders 251*a* disposed side by side in the width direction may be provided. It is possible to individually adjust the pressing force to the sidewall 211 and the pressing force to the sidewall 212 if there are two cylinders including a cylinder that presses the sidewall 211 side and a cylinder that presses the sidewall 212 side. Instead of the cylinder device, another pressing device including a plurality of pressing means (rods driven by power of solenoids, other motors, or the like) may be adopted.

Figure 14:
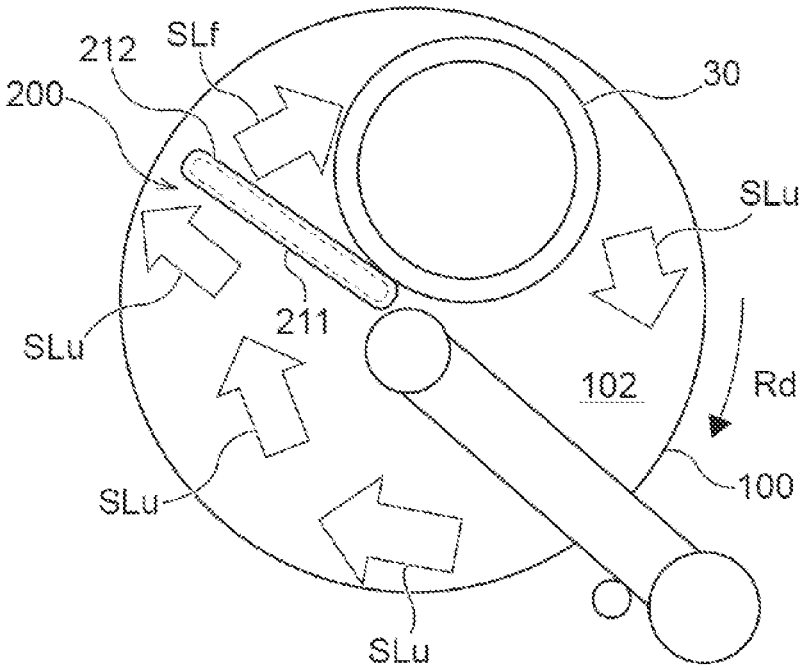
FIG. 14 is a diagram for explaining discharge of used polishing liquid.
Figure 21:
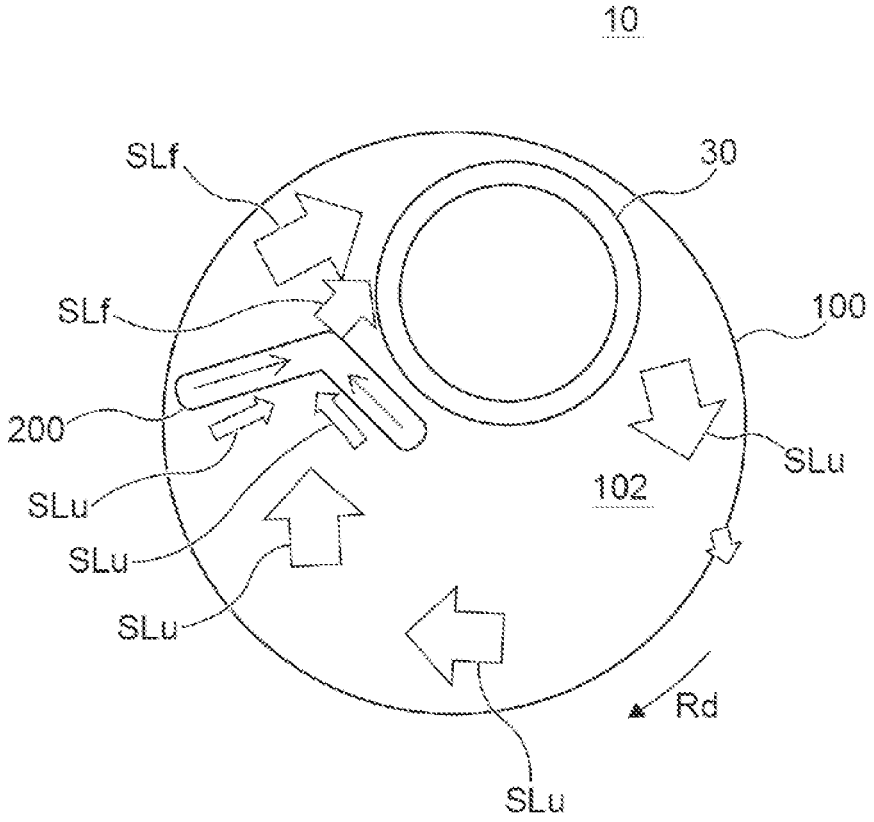
FIG. 21 is a plan view showing a disposition relation among components of a polishing apparatus according to a third embodiment.
Figure 26:
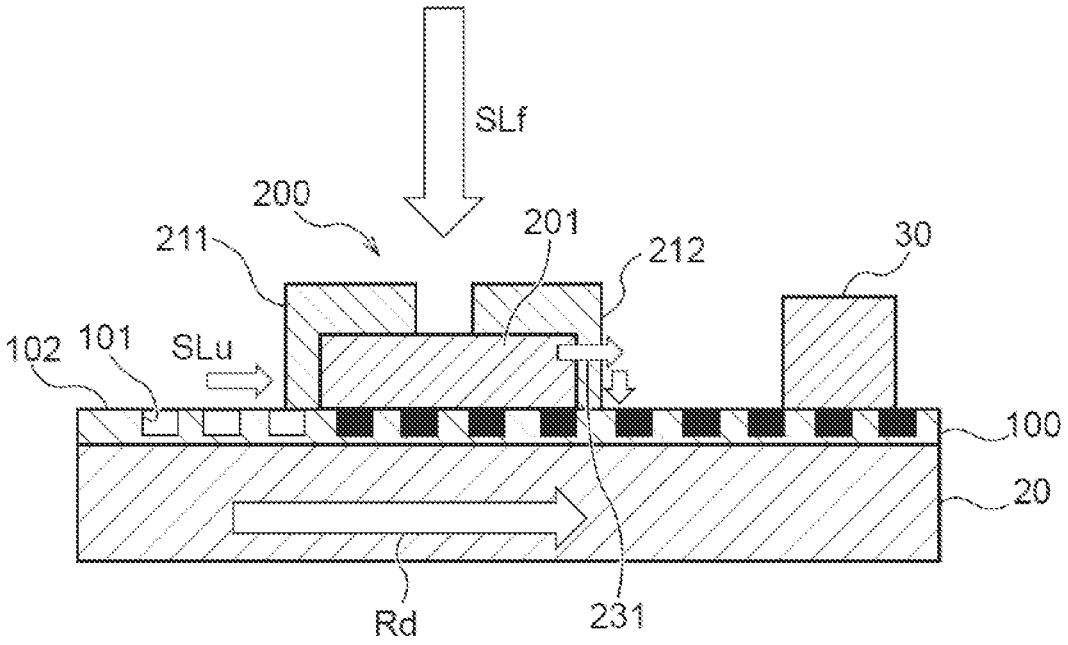
FIG. 26 is a sectional view of a supplying device in which a slit is provided on a secondary side.
Figure 27:
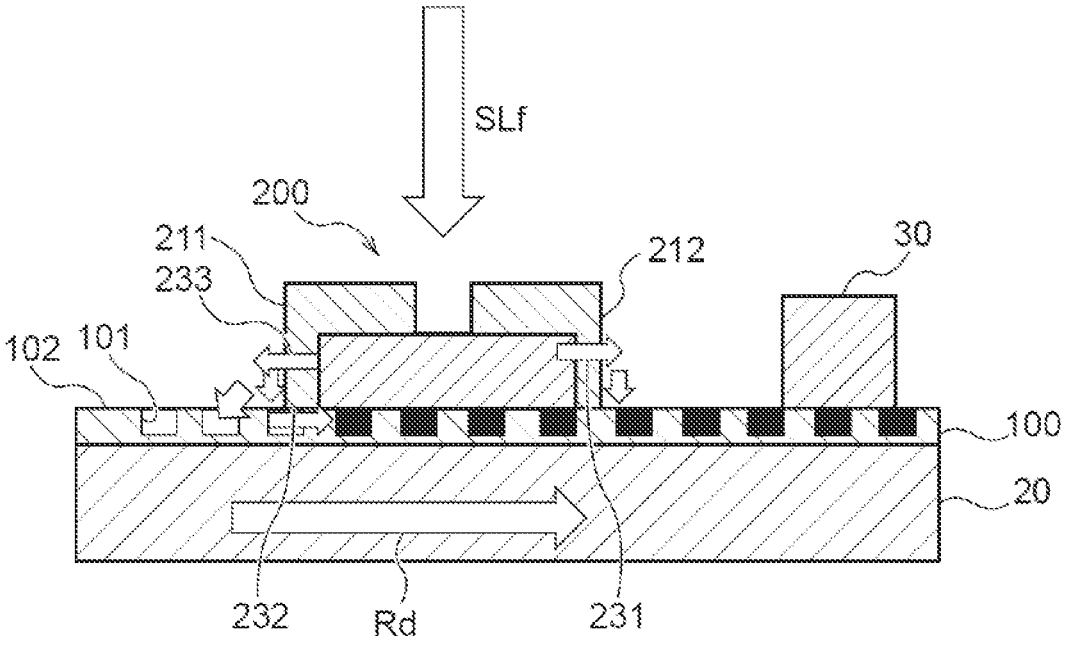
FIG. 27 is a sectional view of a supplying device in which slits are provided on a primary side and a secondary side.

It is possible to prevent used polishing liquid SLu from intruding into the holding space 201 from the sidewall 211 and discharge the used polishing liquid SLu to the outside of the polishing pad 100 along the sidewall 211 by controlling the pressing forces of the plurality of cylinders 251*a* to adjust the pressing force to the sidewall 211 on the upstream side (FIG. 14). It is possible to collect at least a part of the used polishing liquid SLu in the holding space 201 from a gap between the sidewall 211 and the polishing surface 102 by adjusting the pressing force to the sidewall 211 on the upstream side (FIGS. 21, 26, and 27).

A plurality of cylinders disposed side by side in the longitudinal direction of the supplying device 200 may be provided. In this case, pressing forces to places in the longitudinal direction of the supplying device 200 can be adjusted to be different.

Figure 13B:
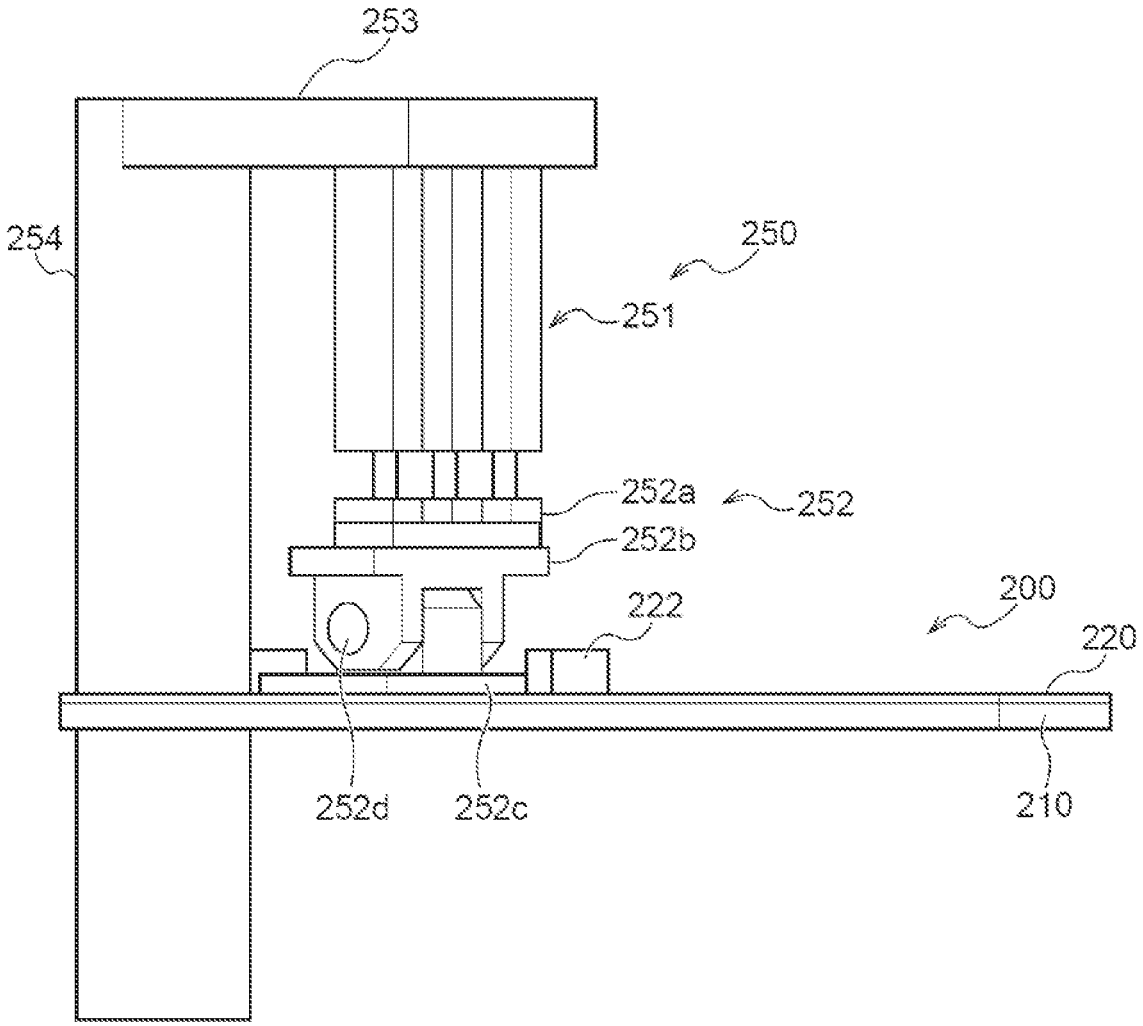
FIG. 13B is a perspective view showing a configuration example of a pressing-posture adjusting mechanism.

As shown in FIGS. 13A and 13B, the pressing-posture adjusting mechanism 252 is disposed between the cylinder device 251 and the supplying device 200 and adjusts the posture of the supplying device 200. The pressing-posture adjusting mechanism 252 includes a first block 252*a*, a second block 252*b* fixed to the first block 252*a*, and a third block 252*c* rotatably engaged with the second block 252*b* via a shaft 252*d*. The first block 252*a* is fixed to the rods of the cylinders 251*a* of the cylinder device 251. The third block 252*c* is fixed to the supplying device 200. With this configuration, when the supplying device 200 is placed on the polishing surface 102, the third block 252*c* of the pressing-posture adjusting mechanism 252 rotates around the shaft 252*d* with respect to the second block 252*b* and the supplying device 200 is set in parallel to the polishing surface 102.

Figure 13C:
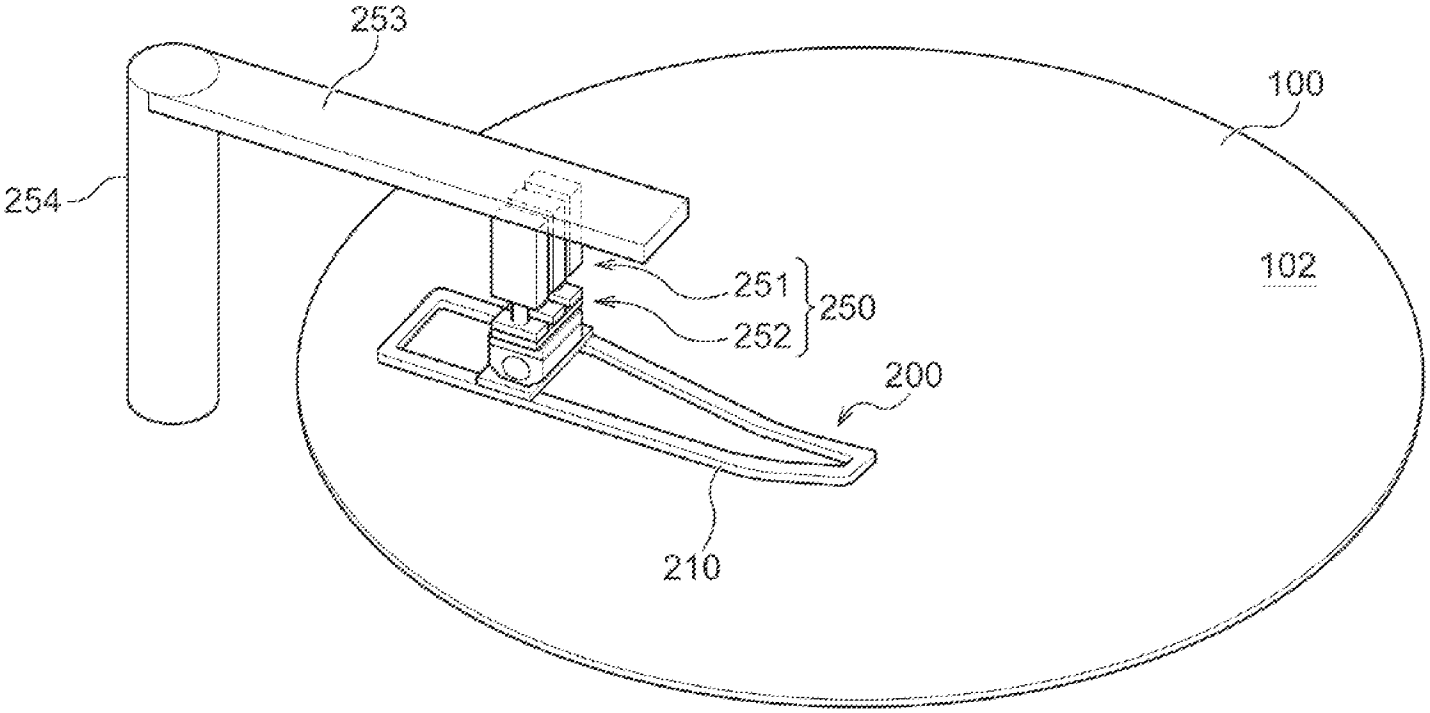
FIG. 13C is a perspective view showing a configuration example of the pressing mechanism.

In FIG. 13A, an example is shown in which the pressing-posture adjusting mechanism 252 is fixed to the top plate (the top cover) 220 of the supplying device 200. However, as shown in FIG. 13C, the top plate (the top cover) 220 may be omitted and the pressing-posture adjusting mechanism 252 may be fixed to the sidewall 210 of the supplying device 200.

FIG. 14 is a diagram for explaining discharge of used polishing liquid. As shown in FIG. 14, the supplying device 200 includes the sidewall 211 on the upstream side in the rotating direction Rd of the polishing pad 100 (a primary side; the downstream side of the top ring 30) and the sidewall 212 on the downstream side in the rotating direction Rd of the polishing pad 100 (a secondary side; the upstream side of the top ring 30). As shown in FIG. 14, it is possible to prevent the polishing liquid SLu used for the polishing treatment in the top ring 30 from intruding into the holding space 201 in the supplying device 200 via the sidewall 211 and it is possible to discharge the used polishing liquid SLu to the outside of the polishing pad 100 with a centrifugal force by the rotation of the polishing table 20 by appropriately adjusting, with the pressing mechanism 250 explained above, a pressing force of the sidewall 211 on the primary side being pressed against the polishing surface 102 of the polishing pad 100. A discharge amount of the used polishing liquid SLu can be adjusted by adjusting a shape and an angle of the sidewall 211 of the supplying device 200 (FIGS. 19A to 19C and 20A to 20C), a pressing force to the sidewall 211 by the pressing mechanism 250, and/or the configuration (the number, disposition, height, a shape, and dimensions (when the slits are provided, as explained below)) of the slits of the sidewall 211.

It is possible to supply new polishing liquid SLf from the holding space 201 of the supplying device 200 to the top ring 30 side via a gap between the sidewall 212 and the polishing surface 102 and it is possible to adjust a supply amount of the new polishing liquid SLf by appropriately adjusting, with the pressing mechanism 250, a pressing force of the sidewall 212 on the secondary side being pressed against the polishing surface 102 of the polishing pad 100. Therefore, with the supplying device 200, the used polishing liquid SLu can be discharged by the sidewall 211 on the primary side and the supply amount of the new polishing liquid SLf can be adjusted by the sidewall 212 on the secondary side. As a result, it is possible to execute the polishing treatment of the substrate Wk with the top ring 30 substantially using only new polishing liquid. It is possible to improve polishing quality (a polishing rate, in-plane uniformity, and the like).

Figure 15A:
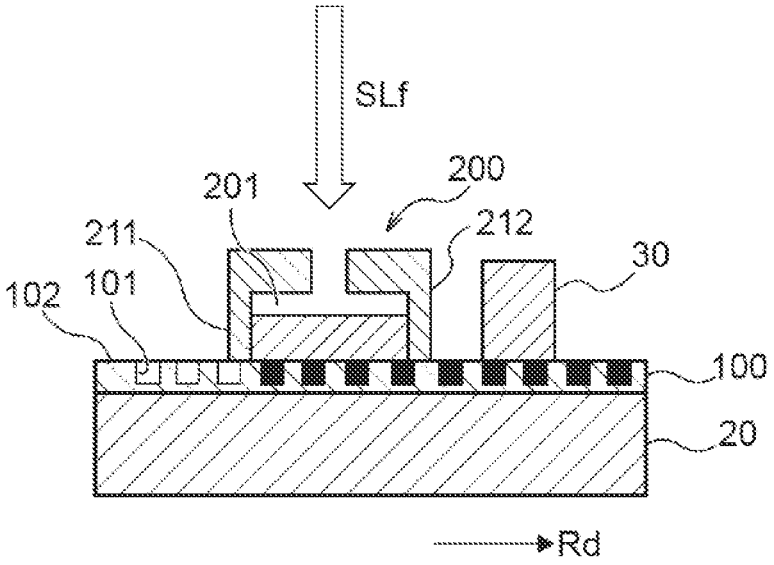
FIG. 15A is a sectional view for explaining use efficiency of new polishing liquid (the second embodiment)
Figure 15B:
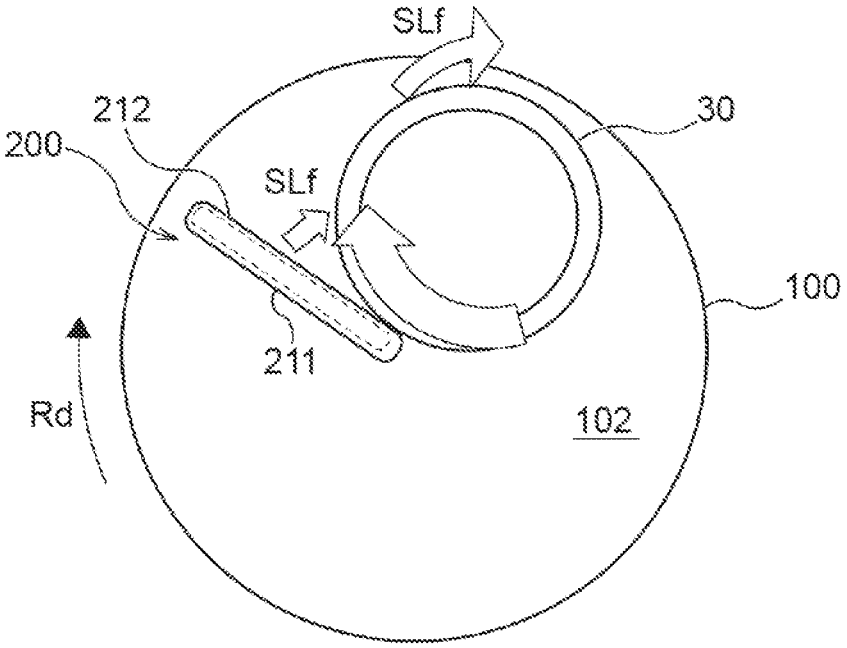
FIG. 15B is a plan view for explaining the use efficiency of the new polishing liquid (the second embodiment)
Figure 16A:
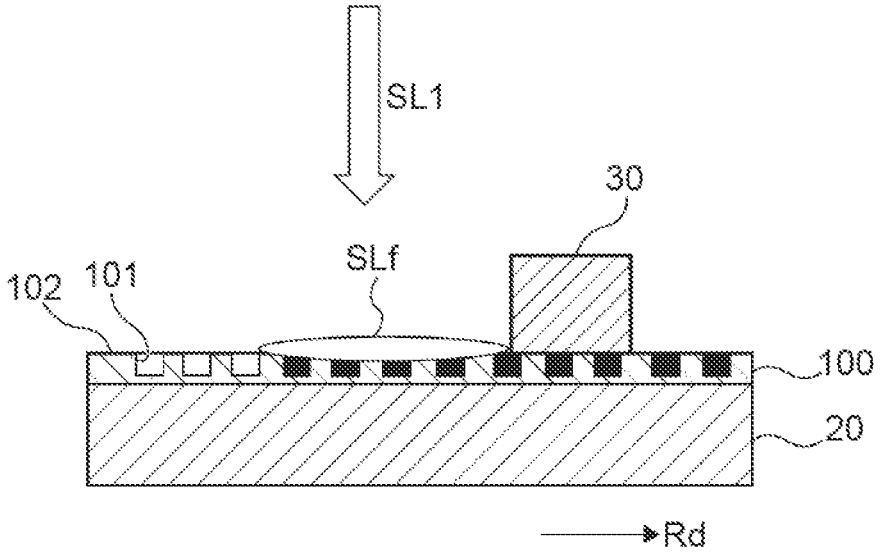
FIG. 16A is a sectional view for explaining use efficiency of new polishing liquid (a comparative example)
Figure 16B:
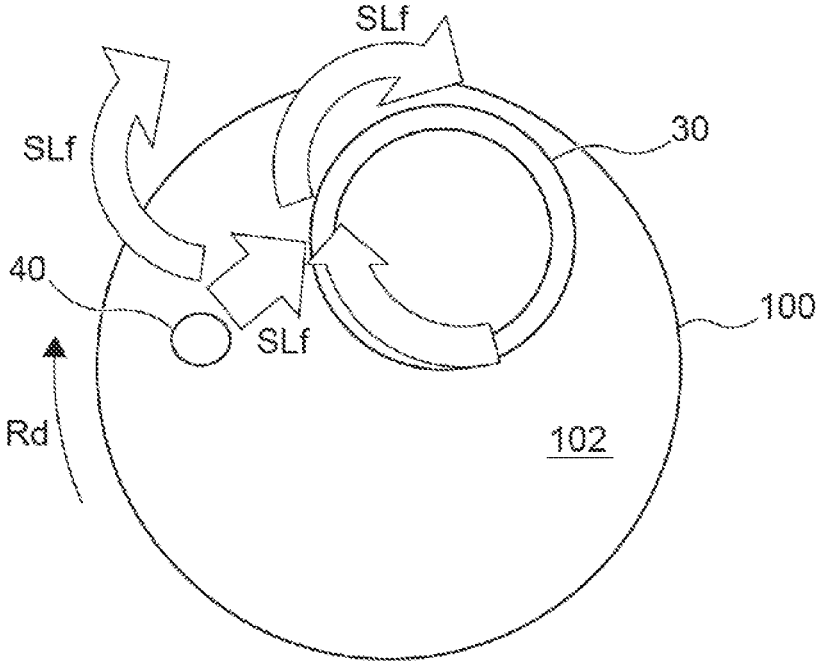
FIG. 16B is a plan view for explaining the use efficiency of the new polishing liquid (the comparative example)

FIGS. 15A and 15B are diagrams for explaining use efficiency of new polishing liquid according to the second embodiment. FIGS. 16A and 16B are sectional views for explaining use efficiency of new polishing liquid according to a comparative example. As shown in FIGS. 16A and 16B, when the polishing liquid is supplied from the polishing-liquid supply nozzle 40 to the polishing surface 102 without using the supplying device 200 according to this embodiment, it is necessary to supply the polishing liquid more than the polishing liquid used for actual polishing treatment in order to supply the polishing liquid to the entire substrate Wk held by the top ring 30. Therefore, as shown in FIG. 16B, it is likely that a lot of new polishing liquid SLf is discharged, without being used for the polishing treatment, by a centrifugal force by the rotation of the polishing pad 100 and pressing of the retainer ring of the top ring 30. On the other hand, in this embodiment, when the polishing surface 102 of the polishing pad 100 passes through the supplying device 200, the polishing liquid SLf is supplied to the polishing surface 102 in the holding space 201, and when the polishing surface 102 of the polishing pad 100 passes the gap between the sidewall 212 and the polishing surface 102, an amount of the polishing liquid on the polishing surface 102 is adjusted. In this case, by adjusting a pressing force to the supplying device 200 (the sidewall 212) by the pressing mechanism 250, a supply amount is adjusted such that an amount of the polishing liquid necessary for the polishing treatment remains after the polishing surface 102 of the polishing pad 100 passes the sidewall 212. For example, the amount of the polishing liquid is adjusted such that the polishing liquid remains mainly in one or more groove sections (pad grooves; porous sections) 101 of the polishing surface 102. The amount of the polishing liquid in sections other than the groove sections 101 can be reduced. In an example, the polishing liquid in the sections other than the groove sections 101 is supplied as a thin layer on the polishing surface. Consequently, as shown in FIG. 15B, on the secondary side (the top ring 30 side) of the supplying device 200, it is possible to greatly reduce an amount of new polishing liquid discharged without being used for the polishing treatment. In other words, with the supplying device 200 in this embodiment, by appropriately adjusting a pressing force to the sidewall 212 on the secondary side of the supplying device 200, it is possible to supply the polishing liquid to a necessary portion at a necessary amount and it is possible to reduce an amount of new polishing liquid discharged without being used for the polishing treatment. The length of the supplying device 200 may be optional. Meanwhile, the length of the supplying device 200 may be generally the same as a substrate diameter or may be the same as a radius, which is a half of the substrate diameter, from a relative relation with the diameter of the substrate Wk held by the top ring 30. The length of the supplying device 200 may be set such that the polishing liquid can be supplied to the entire surface of the substrate Wk or a desired range of the substrate Wk by a desired amount.

An output amount of the polishing liquid on the secondary side (a flow rate of the polishing liquid output from between the sidewall 212 and the polishing surface 102) is adjusted by adjusting a shape and an angle of the sidewall 212 of the supplying device 200 (an angle of the sidewall 212: see FIGS. 19A to 19C and 20A to 20C), a pressing force to the sidewall 212 by the pressing mechanism 250, and/or the configuration (the number, disposition, height, a shape, and dimensions (when the slits are provided, as explained below)) of the slits of the sidewall 212.

Figure 17:
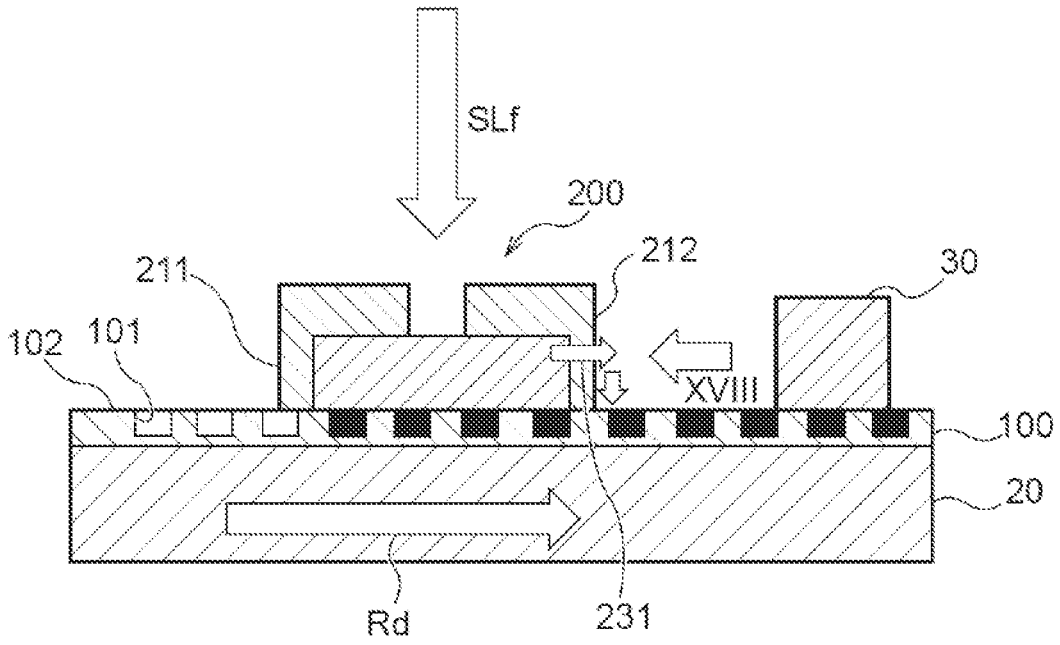
FIG. 17 is a sectional view of a supplying device in which a slit is provided on a secondary side.
Figure 18A:
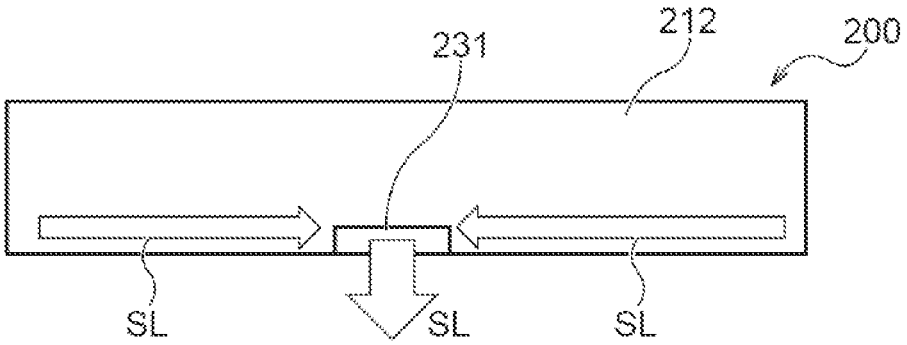
FIG. 18A is an example of the slit on the secondary side.
Figure 18B:
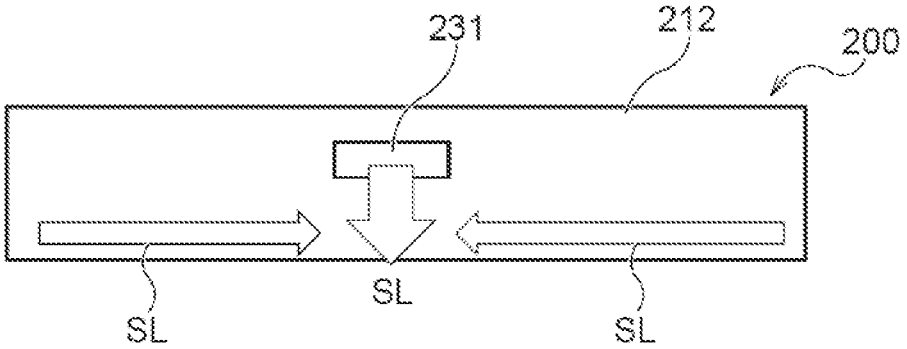
FIG. 18B is an example of the slit on the secondary side.
Figure 18C:
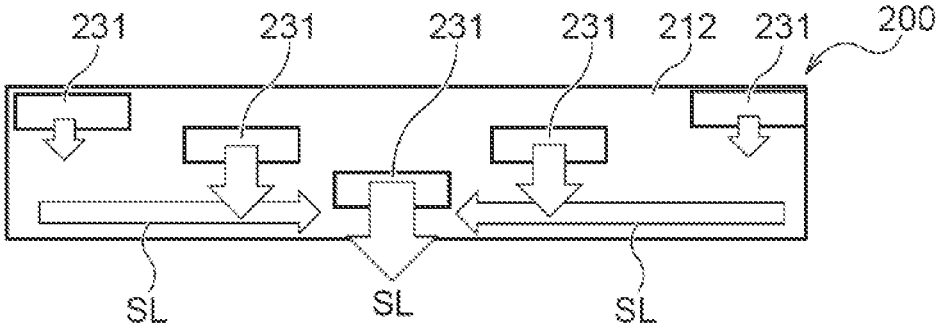
FIG. 18C is an example of the slit on the secondary side.

FIG. 17 is a sectional view of the supplying device 200 in which a slit is provided on the secondary side. FIGS. 18A to 18C are examples of the slit on the secondary side and are arrow views from a direction of an arrow XVIII in FIG. 17. As shown in FIGS. 17 and 18A to 18C, a slit 231 may be provided in the sidewall 212 on the secondary side and the polishing liquid may be supplied from the holding space 201 via the slit 231 in order to control a supply amount and distribution to places of the polishing liquid from the supplying device 200. Consequently, flexibility of adjustment of a supply amount of the polishing liquid from the supplying device 200 (the sidewall 212) can be improved. For example, as shown in FIGS. 18A to 18C, a supply amount of the polishing liquid from the center in the longitudinal direction of the supplying device 200 may be increased. In this case, the slit 231 in the center in the longitudinal direction can be aligned with a track Ck on which the center of the substrate Wk on the polishing surface 102 passes (see FIG. 19C). Consequently, more polishing liquid can be supplied to the center of the substrate Wk. A flow rate of the polishing liquid flowing to the substrate center is adjusted by adjusting shapes and angles of the sidewalls 211 and 212 of the supplying device 200 (an angle of the sidewall 212: FIGS. 19A to 19C and 20A to 20C), the configuration (the number, disposition, height, a shape, and dimensions) of slits, and a pressing force by the pressing mechanism 250.

In the example shown in FIG. 18A, the slit 231 opened at a lower end edge in the center in the longitudinal direction of the sidewall 212 is provided. Consequently, it is possible to actively supply the polishing liquid to the center of the substrate Wk. In the example shown in FIG. 18A, other slits may be added.

In the example shown in FIG. 18B, the slit 231 opened in a position higher than the lower end edge in the center in the longitudinal direction of the sidewall 212 is provided. In this case, after the polishing liquid is accumulated or held to the height of the slit 231 in the holding space 201 of the supplying device 200, the polishing liquid is supplied from the slit 231 to the top ring 30 side. In the example shown in FIG. 18B, other slits may be added.

In the example shown in FIG. 18C, a plurality of slits 231 are provided in the longitudinal direction of the sidewall 212. The height of the slit 231 in the center is the smallest. The heights of the slits 231 increase further away from the center. In this case, a flow rate of the polishing liquid from the slit 231 in the center is the largest. Flow rates of the polishing liquid from the slits 231 decrease further away from the center. It is possible to adjust the flow rates of the polishing liquid from the slits 231 by adjusting the heights of the slits 231.

Besides the illustrations in FIGS. 18A to 18C, slits can be provided by any number, in any disposition, at any height, and in any shape and dimensions in the sidewall on the secondary side. For example, not only in the center of the substrate Wk, one or a plurality of slits can be provided according to a process such that a flow rate from a slit in any position increases or decreases.

Figure 19A:
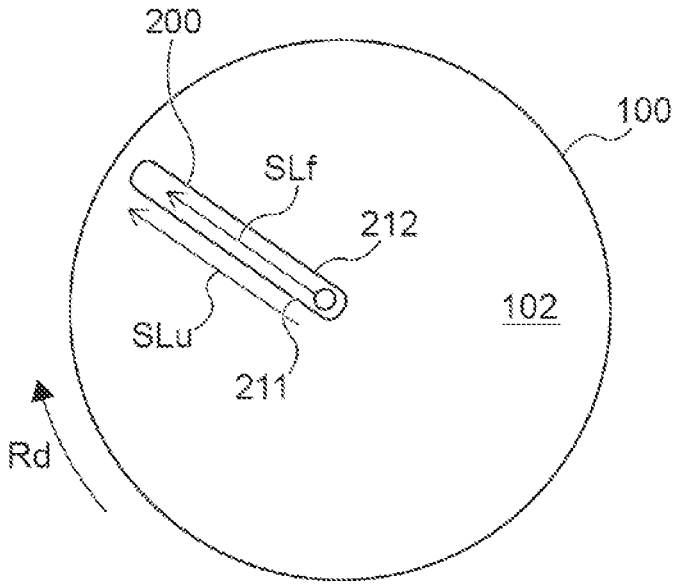
FIG. 19A is a diagram for explaining an accumulating direction of the polishing liquid in the supplying device.
Figure 19B:
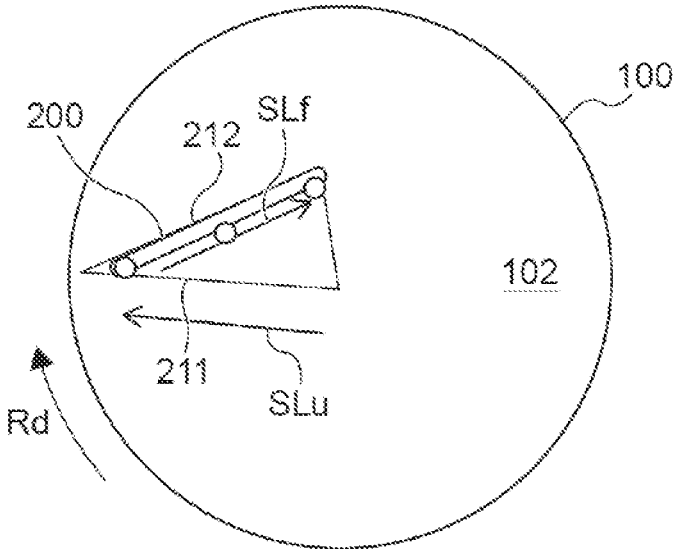
FIG. 19B is a diagram for explaining the accumulating direction the polishing liquid in the supplying device.
Figure 19C:
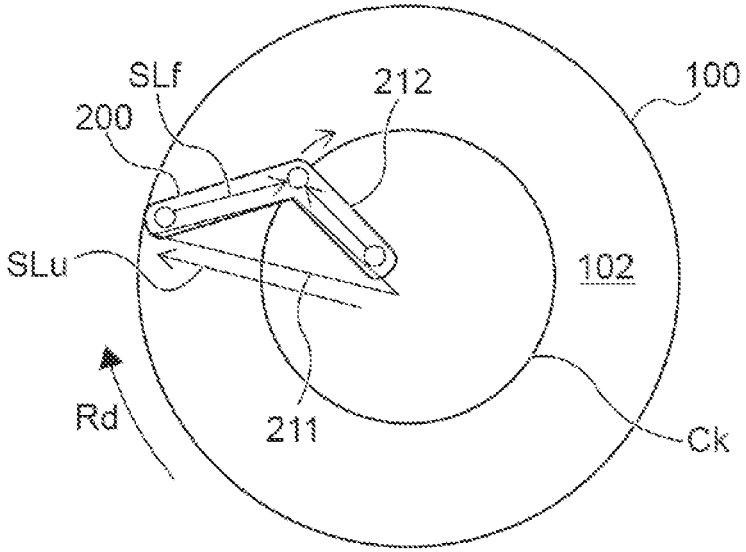
FIG. 19C is a diagram for explaining the accumulating direction of the polishing liquid in the supplying device.
Figure 20A:
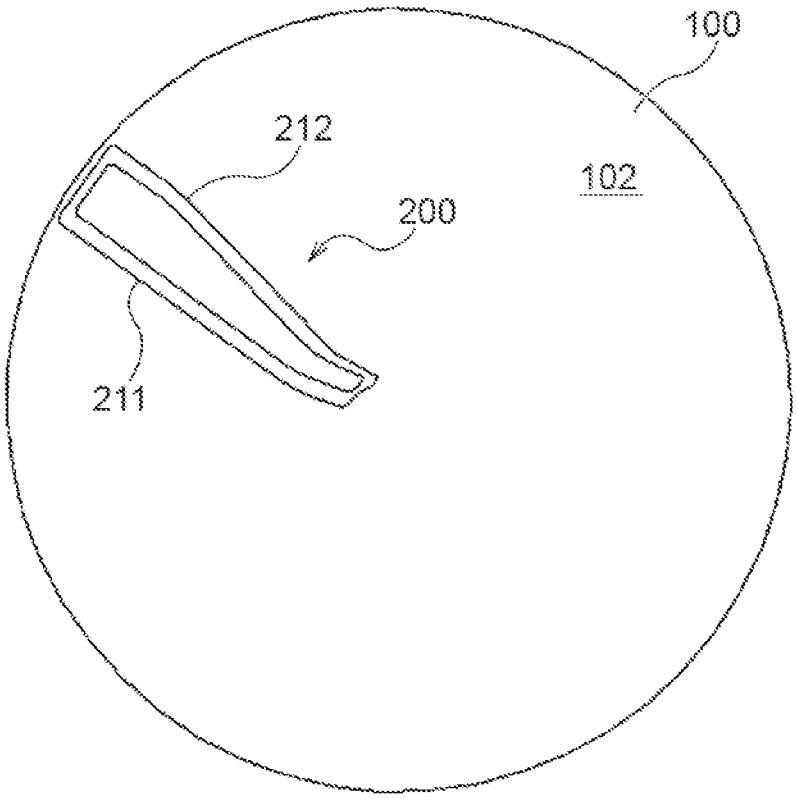
FIG. 20A is a plan view showing an example of a shape of the supplying device.
Figure 20B:
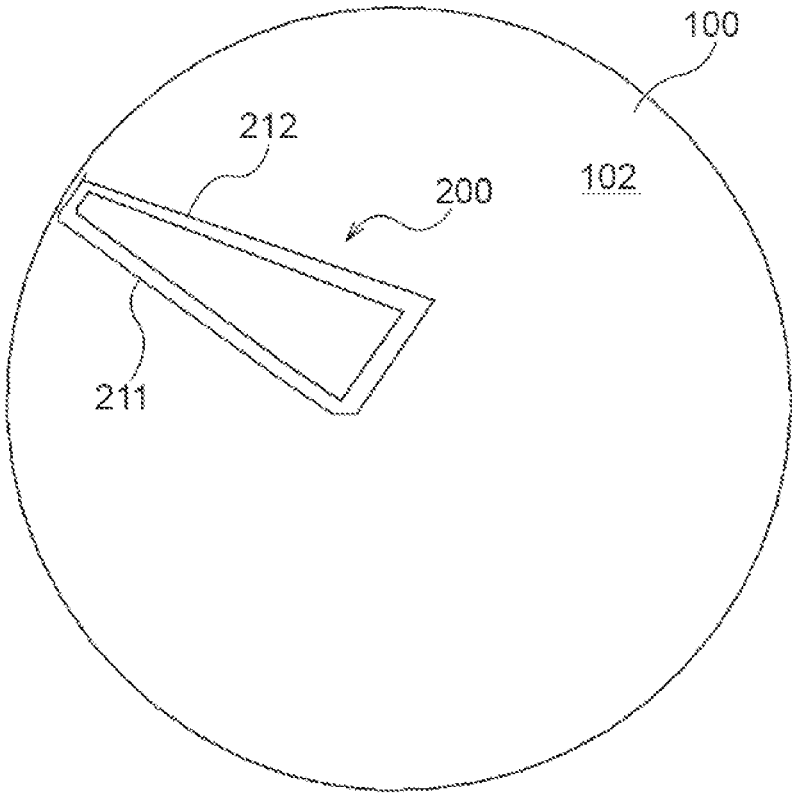
FIG. 20B is a plan view showing an example of the shape of the supplying device.
Figure 20C:
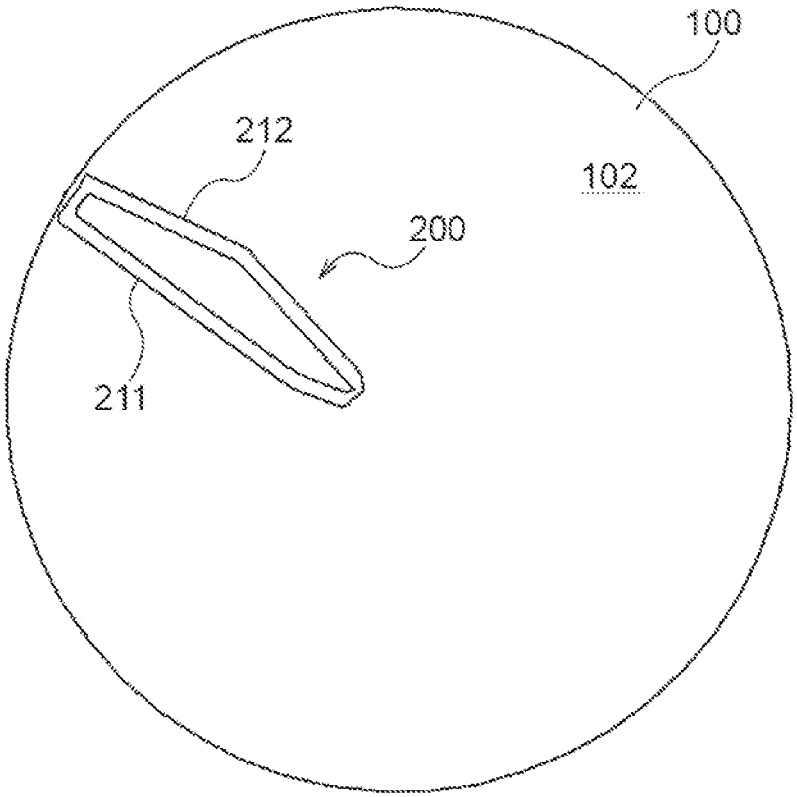
FIG. 20C is a plan view showing an example of the shape of the supplying device.

FIGS. 19A to 19C are diagrams for explaining an accumulating direction of the polishing liquid in the supplying device 200. FIGS. 20A to 20C are plan views showing examples of the shape of the supplying device 200.

As shown in FIGS. 19A and 20A, when the radial-direction outer side end portion in the polishing pad 100 of the sidewall 212 on the secondary side of the supplying device 200 is disposed to precede the other portions in the rotating direction Rd, the polishing liquid SLf in the holding space 201 of the supplying device 200 flows from the inner side toward the outer side and is accumulated from the outer side. The radial-direction outer side end in the polishing pad 100 of the sidewall 211 on the primary side of the supplying device 200 is disposed to precede the other portions in the rotating direction Rd. The used polishing liquid SLu is enabled to easily flow outward in the radial direction by the sidewall 211. In this case, as shown in FIG. 20A, the holding space 201 of the supplying device 200 can be formed to expand on the radial direction outer side of the polishing pad 100 in a plan view.

As shown in FIGS. 19B and 20B, when the radial-direction inner side end portion in the polishing pad 100 of the sidewall 212 on the secondary side of the supplying device 200 is disposed to precede the other portions in the rotating direction Rd, the polishing liquid SLf in the holding space 201 of the supplying device 200 flows from the outer side toward the inner side and is accumulated from the inner side. On the other hand, the radial-direction outer in the polishing pad 100 of the sidewall 211 on the primary side of the supplying device 200 is disposed to precede the other portions in the rotating direction Rd. The used polishing liquid SLu is enabled to easily flow outward in the radial direction by the sidewall 211. In this case, as shown in FIG. 20B, the holding space 201 of the supplying device 200 can be formed to expand on the radial direction inner side of the polishing pad 100 in a plan view.

As shown in FIGS. 19C and 20C, when the center of the sidewall 212 on the secondary side of the supplying device 200 is disposed to precede in the rotating direction Rd, the polishing liquid in the holding space 201 of the supplying device 200 flows from both the sides toward the center and is accumulated from the center side. In this example, the sidewall 212 has a shape bent near the center. On the other hand, the radial-direction outer side end portion in the polishing pad 100 of the sidewall 211 on the primary side of the supplying device 200 is disposed to precede the other portions in the rotating direction Rd. The used polishing liquid SLu is enabled to easily flow outward in the radial direction by the sidewall 211. In this case, as shown in FIG. 20C, the holding space 201 of the supplying device 200 can be formed to expand on the center side in a plan view. The center of the supplying device 200 can be aligned with the track Ck on which the center of the substrate Wk passes. With this configuration, it is possible to accumulate the polishing liquid in the holding space 201 from the center side. It is possible to actively supply the polishing liquid to the center of the substrate.

Besides the illustrations in FIGS. 19A to 19C and 20A to 20C, the supplying device 200 can be configured to accumulate the polishing liquid from any position in the longitudinal direction of the supplying device 200. For example, in a portion where the polishing liquid is desired to be accumulated first, the sidewall 212 on the secondary side is disposed to precede in the rotating direction of the polishing pad 100 than the other portions. The polishing liquid can be actively supplied from the portion.

It is possible to adjust a supply amount of the polishing liquid output from the supplying device 200 according to a place by adjusting a direction of accumulation of the polishing liquid in the holding space 201 of the supplying device 200 as explained above. For example, when a lot of polishing liquid is supplied to the center of the substrate, the polishing liquid is accumulated from the center side in the holding space 201. Further, slits may be provided in the sidewall 212 on the downstream side to increase a supply amount to the substrate center (see FIGS. 18A to 18C).

According to this embodiment, the used polishing liquid is discharged on the primary side of the supplying device 200 and new polishing liquid is supplied to the substrate from the secondary side. Polishing can be performed using only the new polishing liquid. Consequently, it is possible to improve polishing quality (a polishing rate, in-plane uniformity, and the like). It is also possible to suppress defects of the substrate due to the polishing treatment. Separate components for removing the used polishing liquid can be omitted.

Third Embodiment

FIG. 21 is a plan view showing a disposition relation among components of a polishing apparatus according to a third embodiment. Illustration of a dresser and an atomizer is omitted. However, the dresser and the atomizer may be set according to necessity. In this embodiment, the supplying device 200 collects, on the primary side, at least a part of the used polishing liquid SLu in the holding space 201. The supplying device 200 mixes the used polishing liquid SLu and polishing liquid supplied anew (new polishing liquid) SLf in the holding space 201 and outputs mixed polishing liquid to the secondary side. In FIG. 21, for convenience of explanation, the polishing liquid output from the supplying device 200 is indicated by respective arrows of the new polishing liquid SLf and the used polishing liquid SLu. However, actually, the mixed polishing liquid of the new polishing liquid SLf and the used polishing liquid SLu is output.

It is possible to further reduce a consumption amount of the polishing liquid by collecting and reusing at least a part of the used polishing liquid SLu. It is known that, depending on a process, it is possible to improve polishing quality (a polishing rate, in-plane uniformity, and the like) by mixing the used polishing liquid SLu in the new polishing liquid SLf and using the mixed liquid for the polishing treatment. Therefore, according to this embodiment, it is possible to further reduce the consumption amount of the polishing liquid and it is possible to improve the polishing quality. It is possible to suppress defects of the substrate due to the polishing treatment.

Figure 22:
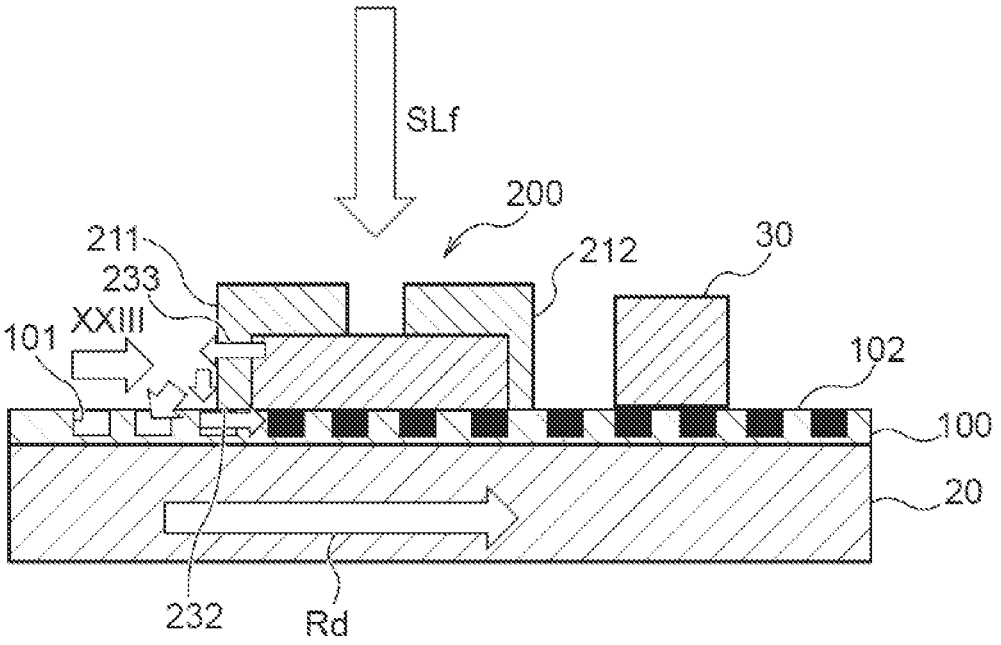
FIG. 22 is a sectional view of a supplying device in which a slit is provided on a primary side.
Figure 23:
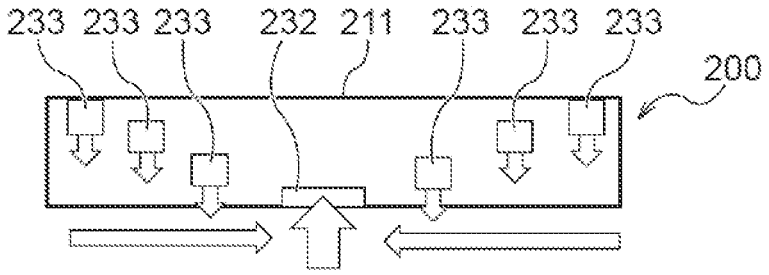
FIG. 23 is an example of the slit on the primary side.
Figure 24:
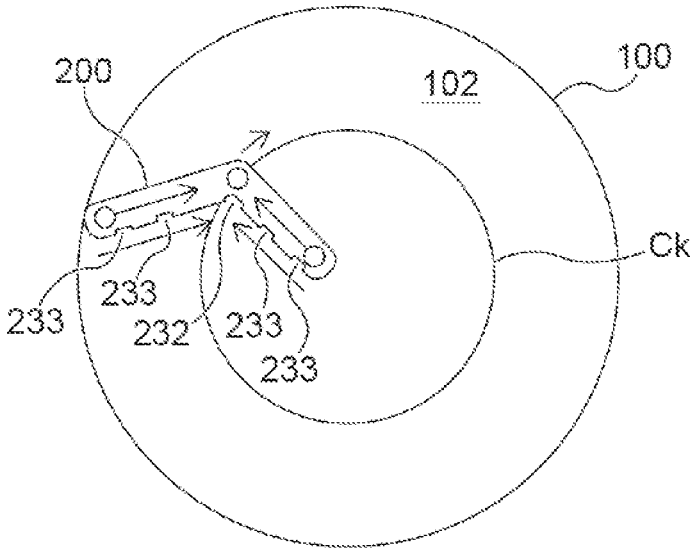
FIG. 24 is a plan view of the supplying device for explaining a flow of collection of polishing liquid.

FIG. 22 is a sectional view of a supplying device in which slits are provided on the primary side. FIG. 23 is an example of the slits on the primary side and is an arrow view from a direction of an arrow XXIII in FIG. 22. FIG. 24 is a plan view of the supplying device for explaining a flow of collection of the polishing liquid. As shown FIGS. 22 to 24, slits 232 and 233 for causing the holding space 201 to communicate with the outside are provided in the sidewall 211 on the primary side of the supplying device 200. The slit 232 is a slit for collecting the used polishing liquid. The used polishing liquid is collected in the holding space 201 via the slit 232 by a force of the rotation of the polishing table 20. The slit 233 is a slit for returning the polishing liquid overflowing in the holding space 201 to the side of the sidewall 211 on the primary side. Consequently, the used polishing liquid and the polishing liquid in the holding space 201 are satisfactorily mixed. Only one of the slits 232 and 233 may be provided.

As shown in FIG. 23, the slit 232 is disposed substantially in the center in the longitudinal direction of the sidewall 211 and opened at the lower end edge of the sidewall 211. A plurality of slits 233 are disposed on both sides of the slit 232 and increase in height further away from the slit 232. The slits 232 and 233 can be provided by any numbers, in any disposition, at any heights, and in any shapes and dimensions. The slits 232 for collection may be provided in plurality. The slit 233 for discharge may be provided in singularity.

During the polishing treatment, as shown in FIGS. 23 and 24, the polishing liquid on the primary side (the sidewall 211 side) is gathered toward the slit 232 present substantially in the center and collected via the slit 232 by a force of the rotation of the polishing pad 100.

During the polishing processing, the new polishing liquid SLf and the collected used polishing liquid SLu are present in a mixed state in the holding space 201. However, a part of the polishing liquid in the mixed state is returned to the primary side via the slits 233. Therefore, in the supplying device 200, the following is repeated: a part of the polishing liquid in the holding space 201 is output to the secondary side and returned to the primary side via the slits 233 and the polishing liquid on the primary side (the used polishing liquid and the polishing liquid in the holding space 201) is introduced in the holding space 201 via the slit 232. An output amount of the polishing liquid on the secondary side can be adjusted in the same manner as explained in the first embodiment.

Figure 25:
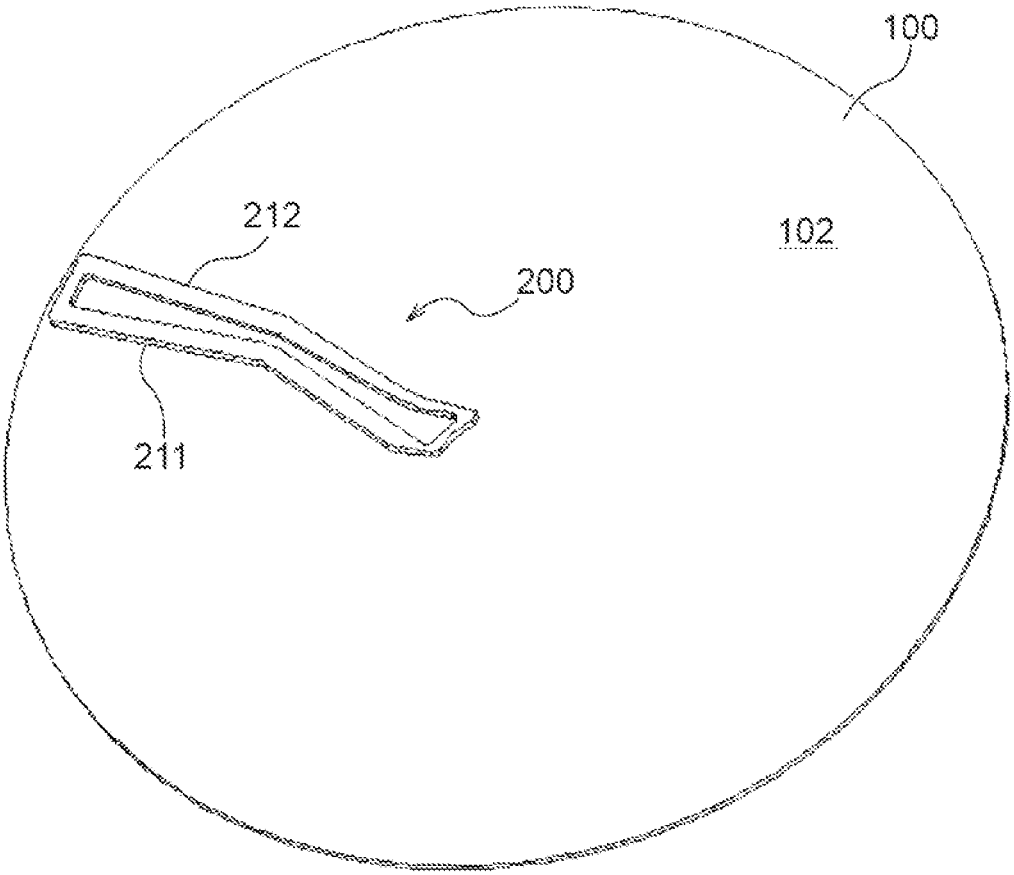
FIG. 25 is a plan view showing an example of a shape of the supplying device.

FIG. 25 is a plan view showing an example of the shape of the supplying device 200. In this example, the sidewall 211 and the sidewall 212 are respectively have shapes bent near the centers. The sidewall 211 on the primary side has a shape in which the center of the sidewall 211 precedes in the rotating direction Rd of the polishing pad 100. It is possible to adjust a collection amount of the polishing liquid by adjusting the shape and the angle of the sidewall 211 on the primary side (see FIG. 25), the configuration (the number, disposition, height, and a shape and dimensions) of the slit 231, and a pressing force by the pressing mechanism 250. In the example shown in FIG. 25, the sidewall 212 on the secondary side has a shape in which the center of the sidewall 212 precedes in the rotating direction Rd of the polishing pad 100. Consequently, as shown in FIG. 24, the polishing liquid in the holding space 201 flows from both ends in the longitudinal direction of the holding space 201 toward the center and accumulates from the center side. Therefore, it is possible to collect the polishing liquid from the center on the primary side of the supplying device 200 and increase an output of the polishing liquid from the center on the secondary side.

As the shape of the supplying device 200, the shapes explained with reference to FIGS. 19A to 19C and 20A to 20C may be adopted.

FIG. 26 is a sectional view of the supplying device 200 in which a slit is provided on the secondary side. In this example, a slit is not provided in the sidewall 211 on the primary side and the same slit 231 as the slit 231 shown in FIGS. 18A to 18C is provided in the sidewall 212 on the secondary side. Collection of the polishing liquid on the primary side is performed by adjusting a pressing force to the sidewall 211 by the pressing mechanism 250. The used polishing liquid is collected in the holding space 201 from the gap between the sidewall 212 on the primary side and the polishing surface 102. It is possible to adjust a collection amount of the polishing liquid by adjusting the shape and the angle of the sidewall 211 on the primary side (see FIG. 25) and a pressing force by the pressing mechanism 250. An output amount of the polishing liquid on the secondary side can be adjusted in the same manner as explained in the first embodiment.

FIG. 27 is a sectional view of a supplying device in which slits are provided on the primary side and the secondary side. In this example, the same slits as the slits shown in FIG. 23 are provided in the sidewall 211 on the primary side and the same slit 231 as the slit 231 shown in FIGS. 18A to 18C is provided in the sidewall 212 on the secondary side. Adjustment of a collection amount of the polishing liquid on the primary side can be performed in the same manner as explained in the example shown in FIG. 26. An output amount of the polishing liquid on the secondary side can be adjusted in the same manner as explained in the first embodiment.

A configuration may be adopted in which slits are not provided in both of the sidewalls 211 and 212 on the primary side and the secondary side. In this case, adjustment of a polishing liquid collection amount is performed by adjusting a pressing force to the sidewall 211 by the pressing mechanism 250. Adjustment of a supply amount of the polishing liquid is performed by adjusting a pressing force to the sidewall 212 by the pressing mechanism 250.

Fourth Embodiment

Figure 28:
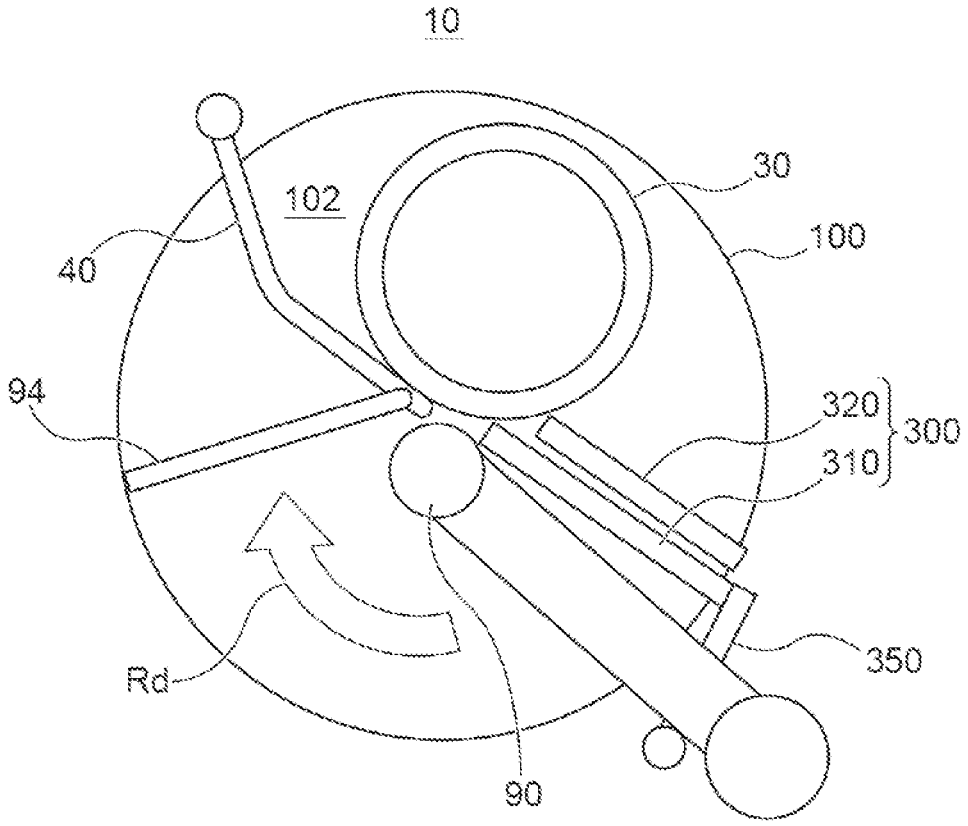
FIG. 28 is a plan view showing a disposition relation among components of a polishing apparatus according to a fourth embodiment.
Figure 29:
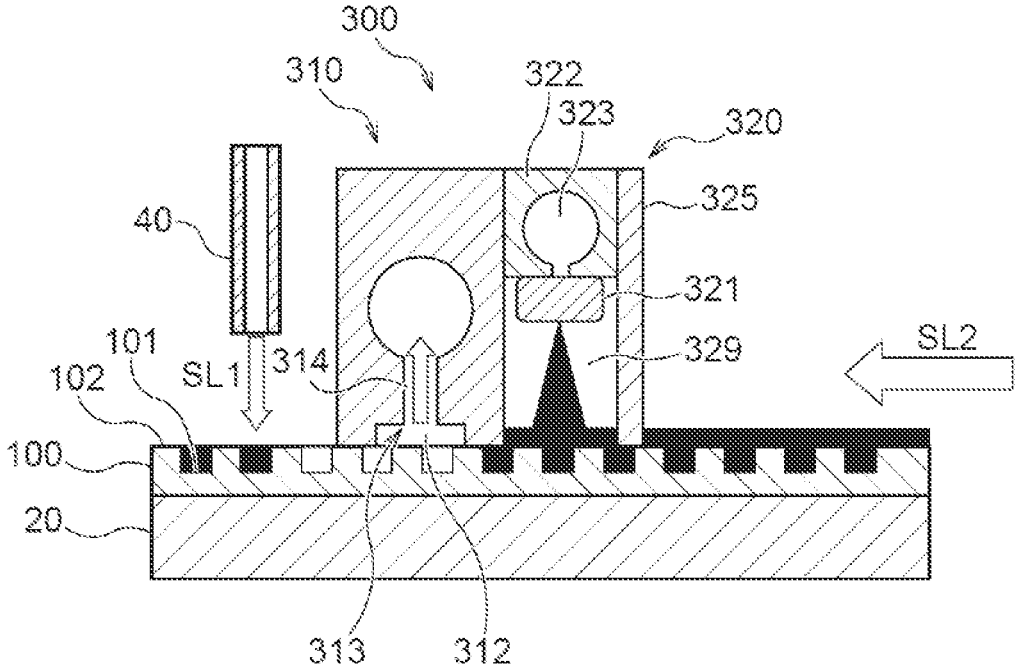
FIG. 29 is a sectional view showing an example of a polishing-liquid removing unit.
Figure 30:
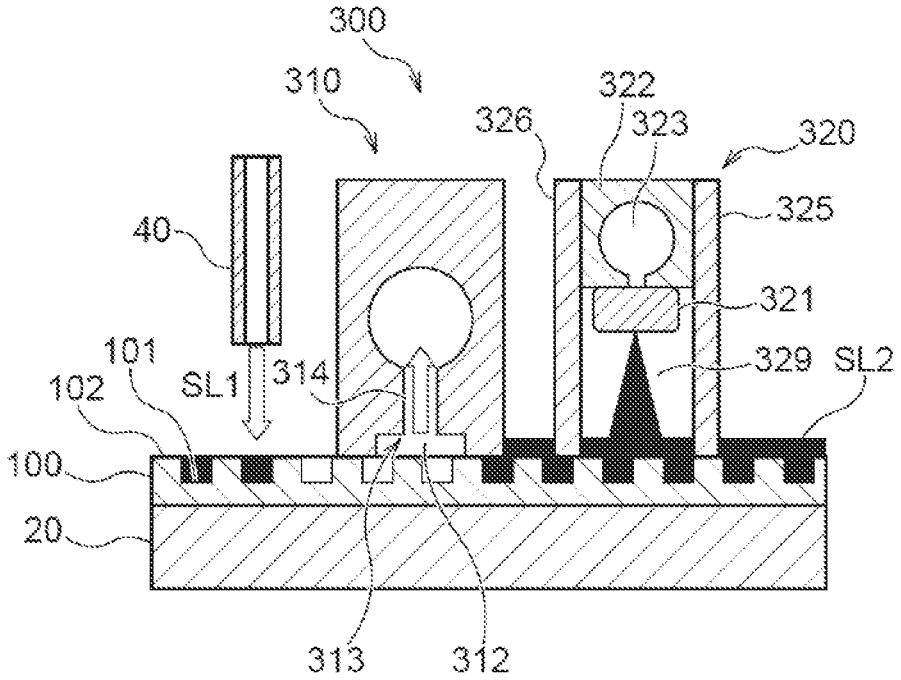
FIG. 30 is a sectional view showing an example of the polishing-liquid removing unit.
Figure 31:
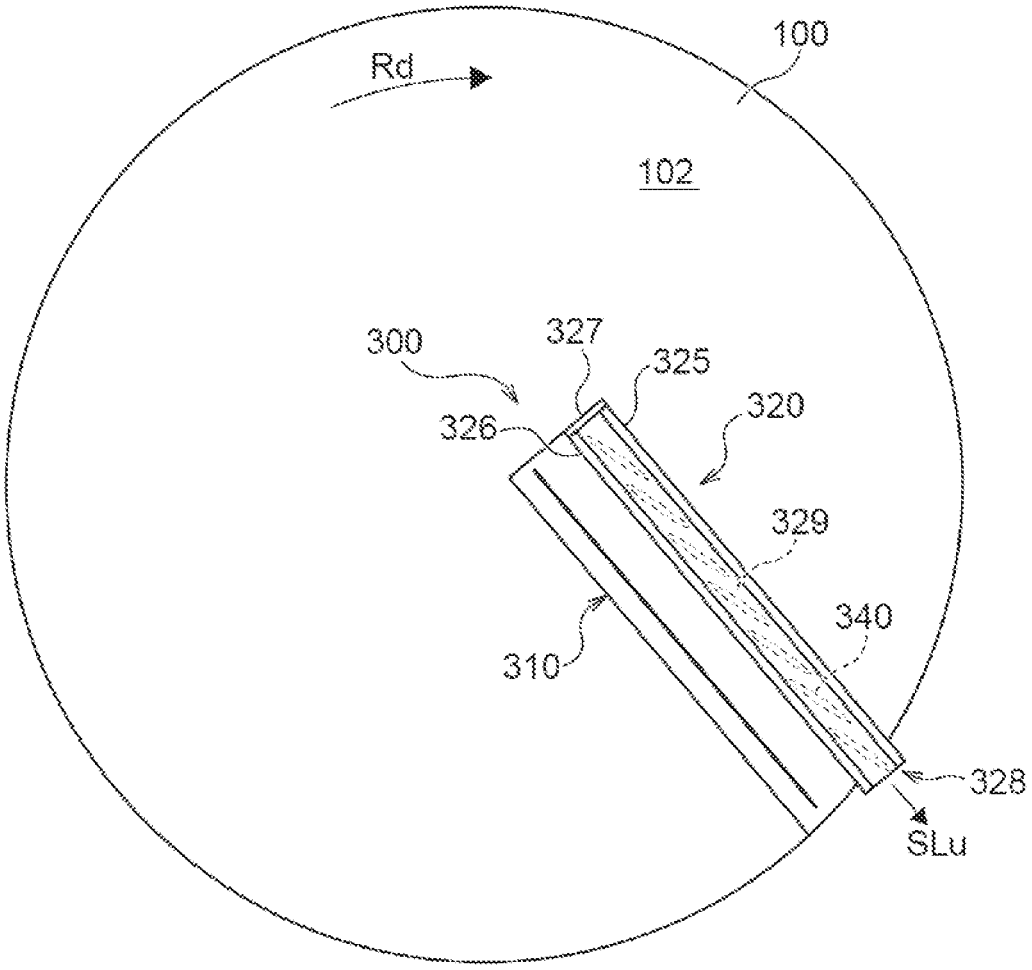
FIG. 31 is a plan view showing an example of the polishing-liquid removing unit.

FIG. 28 is a plan view showing a disposition relation among components of the polishing apparatus 10 according to a fourth embodiment. FIGS. 29 and 30 are sectional views showing examples of a polishing-liquid removing unit. FIG. 31 is a plan view showing an example of the polishing-liquid removing unit. In this embodiment, the polishing apparatus 10 include a polishing-liquid removing unit 300. The polishing-liquid removing unit 300 includes a sucking unit 310 and a cleaning unit 320. The sucking unit 310 and the cleaning unit 320 may be configured as an integrally attached structure or one block (FIG. 29) or may be disposed at an interval as separate blocks (FIG. 30).

The sucking unit 310 has generally the same configuration as the configuration of the sucking unit 56 of the polishing-liquid removing unit 50 explained above with reference to FIGS. 3 and 7. As shown in FIG. 28, the sucking unit 310 has an elongated pad-like shape in a plan view. The sucking unit 310 includes, as shown in FIG. 29, a suction space 312 opened on or to the polishing surface 102, a slit 313 opened in the suction space 312, and a channel 314 to which a not-shown vacuum source is connected. An end portion on the polishing surface 102 side of the sucking unit 310 is disposed in a degree in contact with the polishing surface 102 or in contact with the polishing liquid on the polishing surface 102. As in the example shown in FIGS. 3 and 7, the sucking unit 310 may include the damming unit 52 that dams the polishing liquid on the polishing surface 102.

As shown in FIG. 31, the cleaning unit 320 includes sidewalls (scrapers) 325, 326, and 327 that surround three directions in a plan view. A jetting space 329 is provided to be surrounded by these sidewalls. In FIG. 31, for convenience of explanation, a part of components is omitted. Like the damming unit 52 explained above, as the material of the sidewalls 325, 326, and 327, the same material as the material of the damming unit 52 is desirably selected such that the polishing surface 102 is not scratched and chips of the sidewalls 325, 326, and 327 themselves due to contact with the polishing surface 102 do not remain on the polishing surface 102.

As shown in FIG. 31, in the cleaning unit 320, a sidewall is not provided on the radial direction outer side of the polishing pad 100 and an opening section 328 is formed. The opening section 328 opens the jetting space 329 outward in the radial direction. Cleaning liquid (DIW; HOT DIW) jetted from a cleaning-liquid jetting nozzle 321 and used cleaning liquid SL2 are discharged outward in the radial direction by a centrifugal force of the rotation of the polishing pad 100 (the polishing table 20). A sidewall may be present in a part of the radial-direction outer side end portion in a range not hindering discharge of the polishing liquid. The sidewalls 325, 326, and 327 are disposed in a degree in contact with the polishing surface 102 or slightly not in contact with the polishing surface 102 with a small gap. Depending on a process, heated pure water (HOT DIW) may be used as the cleaning liquid because a polishing rate decreases when the surface temperature of the polishing pad 100 falls. The temperature adjusting unit 60 or 60A explained above or a temperature adjusting unit of another form may be provided in order to adjust the temperature of the polishing surface 102. The temperature adjusting unit can be disposed on the downstream side of the polishing-liquid removing unit 300 and on the upstream side of the top ring 30. The temperature adjusting unit can be disposed on the upstream side or the downstream side of the polishing-liquid supply unit 40 or 200.

The cleaning unit 320 includes, as shown in FIG. 29, the cleaning-liquid jetting nozzle 321 disposed to jet the cleaning liquid toward the jetting space 329 and a channel block 322 including a channel 323 communicating with the cleaning-liquid jetting nozzle 321 to supply the cleaning liquid to the cleaning-liquid jetting nozzle 321. The cleaning liquid (DIW) is supplied from a not-shown fluid supply source to the cleaning-liquid jetting nozzle 321 via the channel 323. The cleaning liquid is jetted from the cleaning-liquid jetting nozzle 321 toward the polishing surface 102 in the jetting space 329. The cleaning-liquid jetting nozzle 321 is mounted such that a jetting angle is orthogonal to or oblique to the polishing surface. The channel block 322 may be formed integrally with the sidewalls 325, 326, and 327 or may be formed separately from the sidewalls 325, 326, and 327. The used polishing liquid, byproducts, and the like in the groove sections 101 of the polishing surface 102 are removed by the jetted cleaning liquid.

Figure 32:
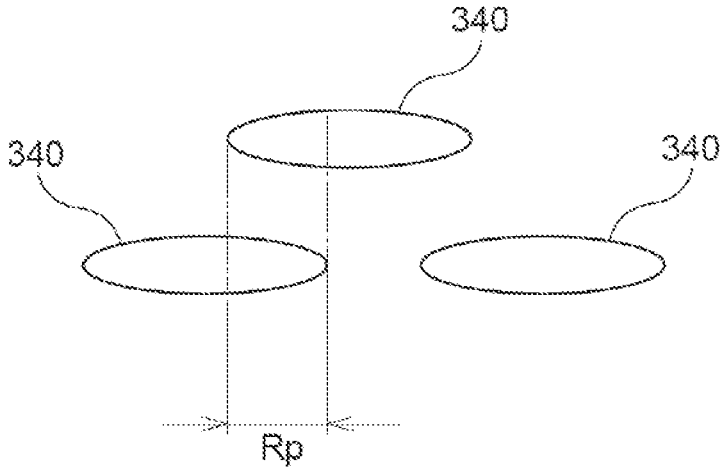
FIG. 32 is a diagram schematically showing a configuration example of a nozzle jetting port.
Figure 33:
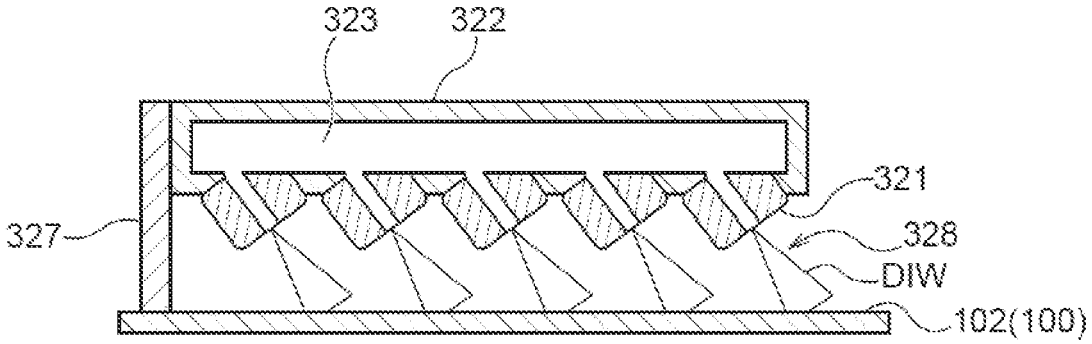
FIG. 33 is a diagram schematically showing a configuration example of the nozzle jetting port.

In the example shown in FIG. 31, nozzle jetting ports 340 of the cleaning-liquid jetting nozzle 321 have an elliptical or fan shape and are disposed to be tilted at a predetermined angle with respect to the longitudinal direction of the cleaning unit 320. In the nozzle jetting ports having the elliptical or fan shape, a jetting flow rate in the center portion is large and a jetting flow rate in an end portion is small. Therefore, the nozzle jetting ports 340 are disposed such that end portions of the nozzle jetting ports 340 adjacent to each other overlap each other in the longitudinal direction of the cleaning unit 320 such that a uniform flow rate can be obtained in an entire region. As shown in FIG. 33, the nozzle jetting ports 340 of the cleaning-liquid jetting nozzle 321 may be directed with an inclination with respect to the polishing surface 102 and to face the radial direction outer side of the polishing surface 102. In this case, the cleaning liquid (DIW) and the used polishing liquid are easily discharged to the outer side from the opening section 328. In the example shown in FIG. 32, the nozzle jetting ports 340 of the cleaning-liquid jetting nozzle 321 has an elliptical or fan shape. The nozzle jetting ports 340 are disposed in parallel to the longitudinal direction of the cleaning unit 320. The nozzle jetting ports 340 are alternately disposed side by side such that the end portions of the nozzle jetting ports 340 adjacent to each other overlap each other in the longitudinal direction of the cleaning unit 320.

Figure 34A:
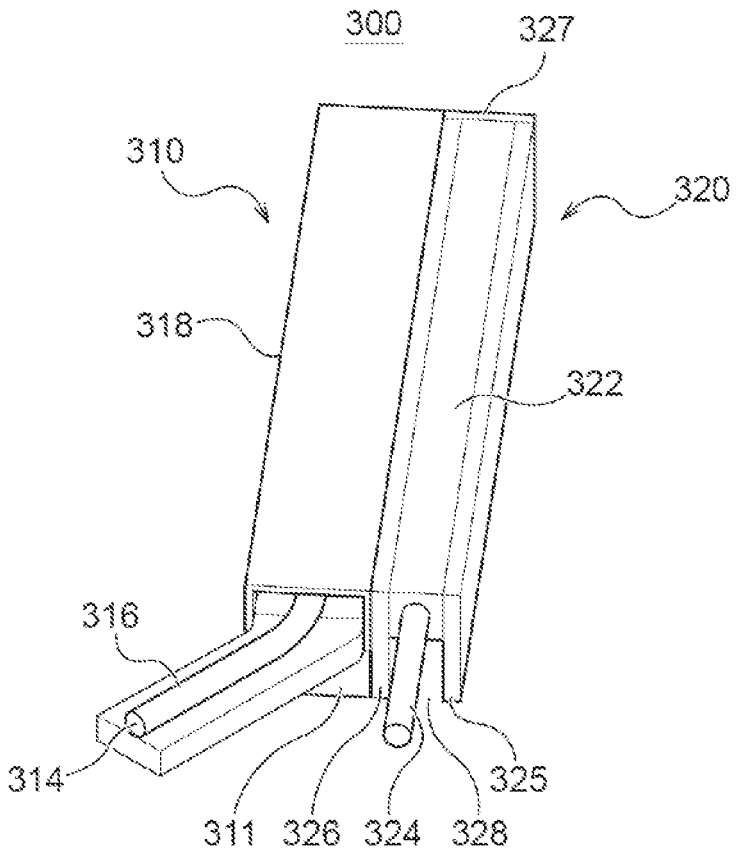
FIG. 34A is a perspective view showing a configuration example of the polishing-liquid removing unit.
Figure 34B:
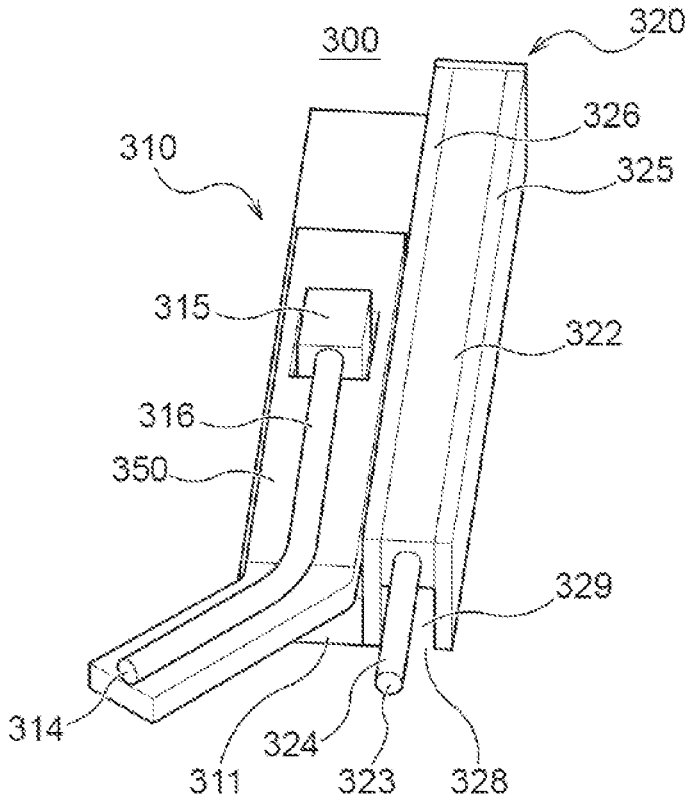
FIG. 34B is a perspective view showing a configuration example of the polishing-liquid removing unit.
Figure 34C:
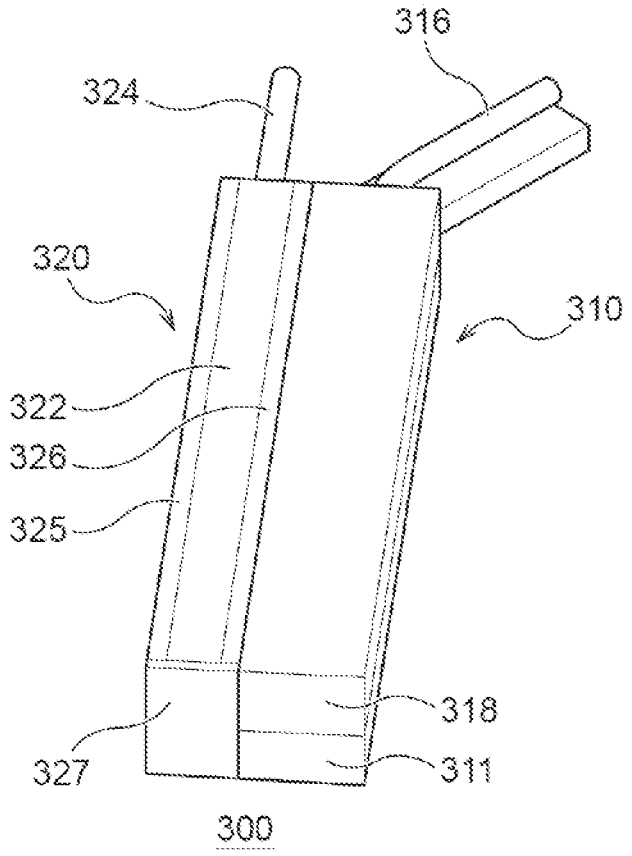
FIG. 34C is a perspective view showing a configuration example of the polishing-liquid removing unit.

FIGS. 34A to 34C are perspective views showing configuration examples of the polishing-liquid removing unit. FIG. 34A is the perspective view viewed from the outer side of the polishing pad 100. FIG. 34B is the perspective view of a state in which a cover of the sucking unit 310 is removed. FIG. 34C is the perspective view viewed from the center side of the polishing surface 102. In the configuration examples shown in FIGS. 34A to 34C, in the cleaning unit 320, the sidewalls 325, 326, and 327 are disposed on the upstream side and the downstream side in the rotating direction of the polishing table 20 and on the center side of the polishing table 20. The channel block 322 is disposed above a space surrounded by the sidewalls 325, 326, and 327. The jetting space 329 is formed below the channel block 322. The jetting space 329 is surrounded by the sidewalls 325, 326, and 327 and the channel block 322. On the outer circumference side of the polishing table 20 of the cleaning unit 320, a sidewall is not provided and the opening section 328 is provided. The jetting space 329 is opened from the opening section 328 on the outer circumference side of the polishing table 20. A pipe 324 is coupled to the channel block 322. The channel 323 is provided in the pipe 324. The channel 323 is connected to the nozzle jetting ports 340 (FIG. 30) of the cleaning-liquid jetting nozzle 321 (FIG. 29).

In the examples shown in FIGS. 34A to 34C, the sucking unit 310 includes a suction block 311 fixed to an arm 350 (see FIG. 28). The suction space 312 (FIGS. 29 and 30) is formed in the suction block 311. A pipe 316 is disposed on the arm 350. One end of the pipe 316 is connected to a not-shown vacuum source. The other end is connected to the suction block 311 via a coupling block 315. The channel 314 extends to the pipe 316, the coupling block 315, and the suction block 311. The channel 314 is connected to the slit 313 (FIGS. 29 and 30) opened in the suction space 312. A cover 318 is attached to an upper part of the suction block 311 to cover the coupling block 315 and the pipe 316. Like the damming unit 52 explained above, as the material of the suction block 311, the same material as the material of the damming unit 52 is desirably selected such that the polishing surface 102 is not scratched and chips of the sucking unit 310 itself due to contact with the polishing surface 102 do not remain on the polishing surface 102.

As shown in FIG. 28, the polishing-liquid removing unit 300 (the cleaning unit 320 and the sucking unit 310) is attached to the arm 350, which is capable of swinging and moving up and down, and can be pressed against the polishing surface 102 of the polishing pad 100. The arm 350 is attached to a column on the outside of the polishing table 20. For example, a cylinder can be used as a lifting and lowering mechanism for moving the arm 350 up and down. In this case, it is possible to control a pressing pressure against the polishing pad 100 by changing, with a regulator (a proportional control valve or the like), the pressure of driving fluid supplied to the cylinder. Further, it is also possible to cancel the weight (own weight) of a mechanism attached to the arm or it is also possible to reduce the pressing pressure to 0. The lifting and lowering mechanism is not limited to the cylinder. A mechanism by power of a motor and any other mechanisms can be adopted. The pressing mechanisms in the second and third embodiments may be used. The cleaning unit 320 and the sucking unit 310 may be attached to separate arms capable of swinging and moving up and down.

With such a polishing-liquid removing unit 300, the cleaning liquid is jetted onto the polishing surface from the cleaning-liquid jetting nozzle 321 in the jetting space 329 of the cleaning unit 320. The used polishing liquid and byproducts on the polishing surface are washed away by the cleaning liquid. The cleaning liquid is discharged outward in the radial direction via the opening section 328 by a centrifugal force of the rotation of the polishing table. Subsequently, the sucking unit 310 removes, with suction, the cleaning liquid present in the groove sections (the pad grooves; the porous portions) on the polishing surface where discharge by the centrifugal force is difficult in the cleaning unit 320. Consequently, it is possible to remove the byproducts and the used polishing liquid on the polishing surface. It is possible to supply only new polishing liquid onto the polishing surface with the polishing-liquid supplying mechanism (the polishing-liquid supply nozzle 40 or 200) disposed behind the sucking unit 310. As a result, it is possible to prevent defects of the substrate and improve polishing quality (a polishing rate, in-plane uniformity, and the like).

In this embodiment, as shown in FIG. 28, the dresser 90 and the atomizer 94 may be provided. The cleaning unit 320 of the polishing-liquid removing unit 300 may be used as an atomizer and the separate atomizer 94 may be omitted. The dresser 90 and the atomizer 94 may be omitted. In the above explanation, a sidewall is not provided on the radial-direction outer side end face of the cleaning unit 320. However, a sidewall may be provided on the radial-direction outer side end face as well such that the entire circumference of the jetting space 329 is surrounded by the sidewalls.

Fifth Embodiment

Figure 35:
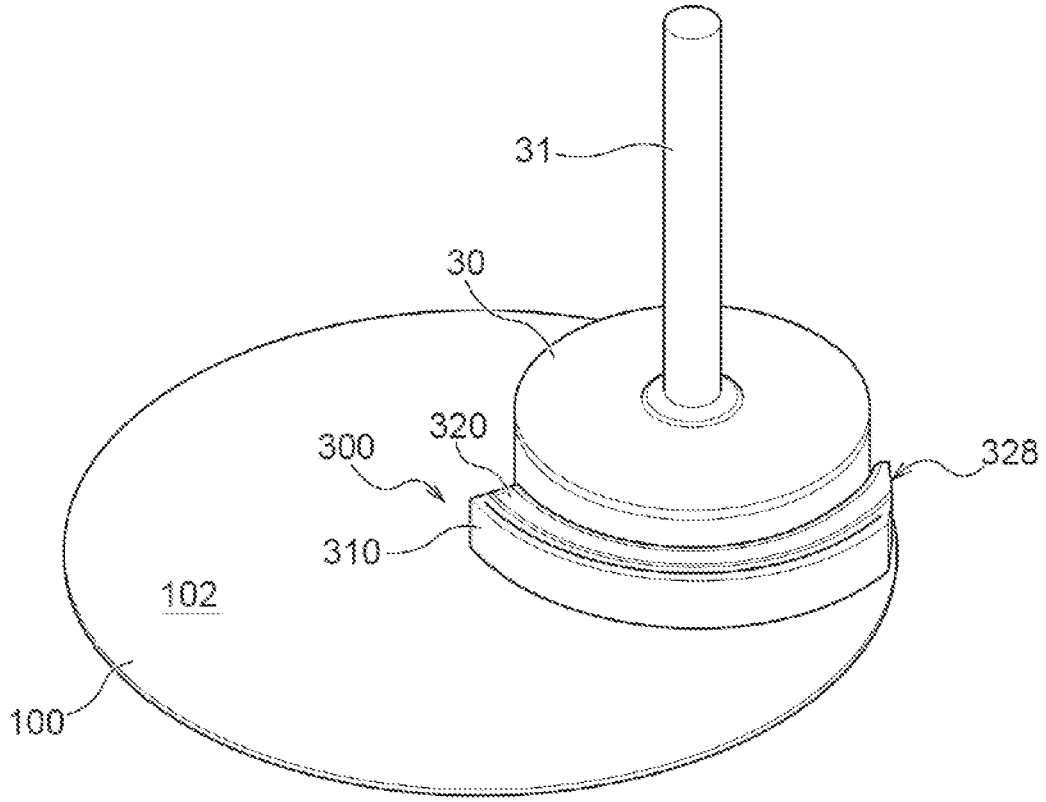
FIG. 35 is a perspective view showing a disposition relation among components of a polishing apparatus according to a fifth embodiment.
Figure 36:
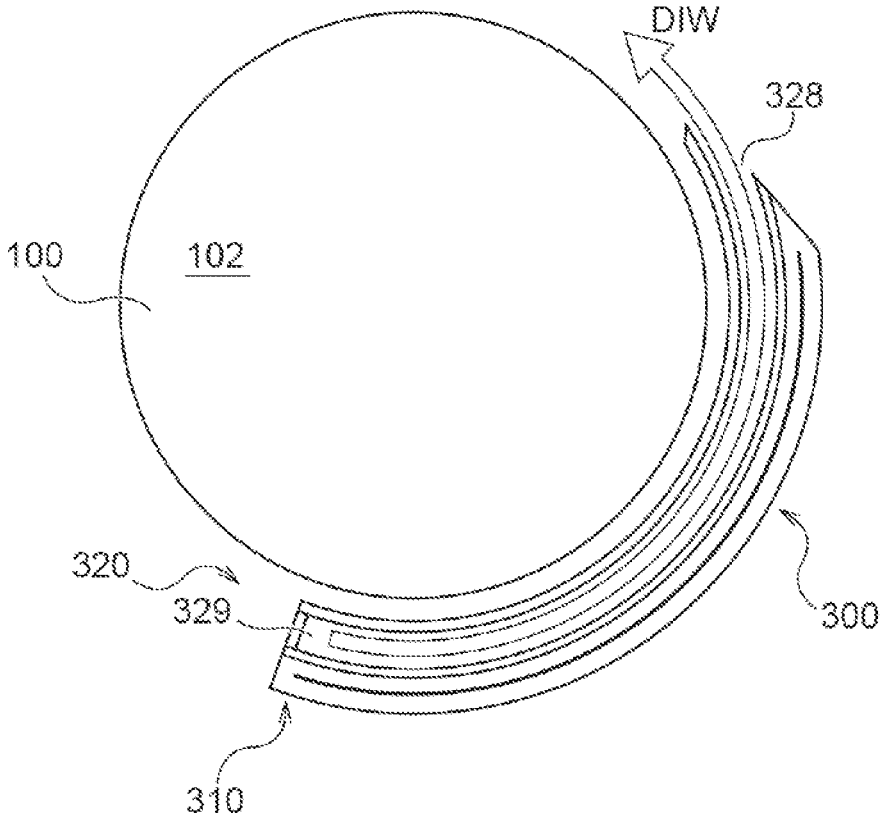
FIG. 36 is a plan view of a polishing-liquid removing unit for explaining discharge of cleaning liquid.

FIG. 35 is a perspective view showing a disposition relation among components of a polishing apparatus according to a fifth embodiment. FIG. 36 is a plan view of a polishing-liquid removing unit for explaining discharge of cleaning liquid. In this embodiment, the polishing-liquid removing unit 300 is configured in a shape conforming to the external shape of the top ring 30 and disposed on the outer side of the top ring 30. The polishing-liquid removing unit 300 in this embodiment is the same as the polishing-liquid removing unit 300 in the fourth embodiment except that the cleaning unit 320 and the sucking unit 310 are formed in arcuate shapes. As in the fourth embodiment, the opening section 328 is provided at the end portion on the radial direction outer side of the cleaning unit 320 (FIG. 36). Therefore, as shown in FIG. 36, the cleaning liquid jetted into the jetting space 329 of the cleaning unit 320 is discharged to the outer side of the polishing surface 102 via the opening section 328 as indicated by an arcuate arrow. In this embodiment as well, the cleaning liquid is guided to the radial direction outer side in the jetting space 329 by the centrifugal force of the polishing table 20, and the nozzle jetting ports 340 of the cleaning-liquid jetting nozzle 321 may be directed with an inclination with respect to the polishing surface 102 and to face the radial direction outer side of the polishing surface 102, as shown in FIG. 33. In this case, the cleaning liquid (DIW) and the used polishing liquid are easily discharged to the outer side from the opening section 328. A plane shape of the nozzle jetting ports 340 can be formed in the same shape as the shape shown in FIGS. 31 and 32.

Figure 37:
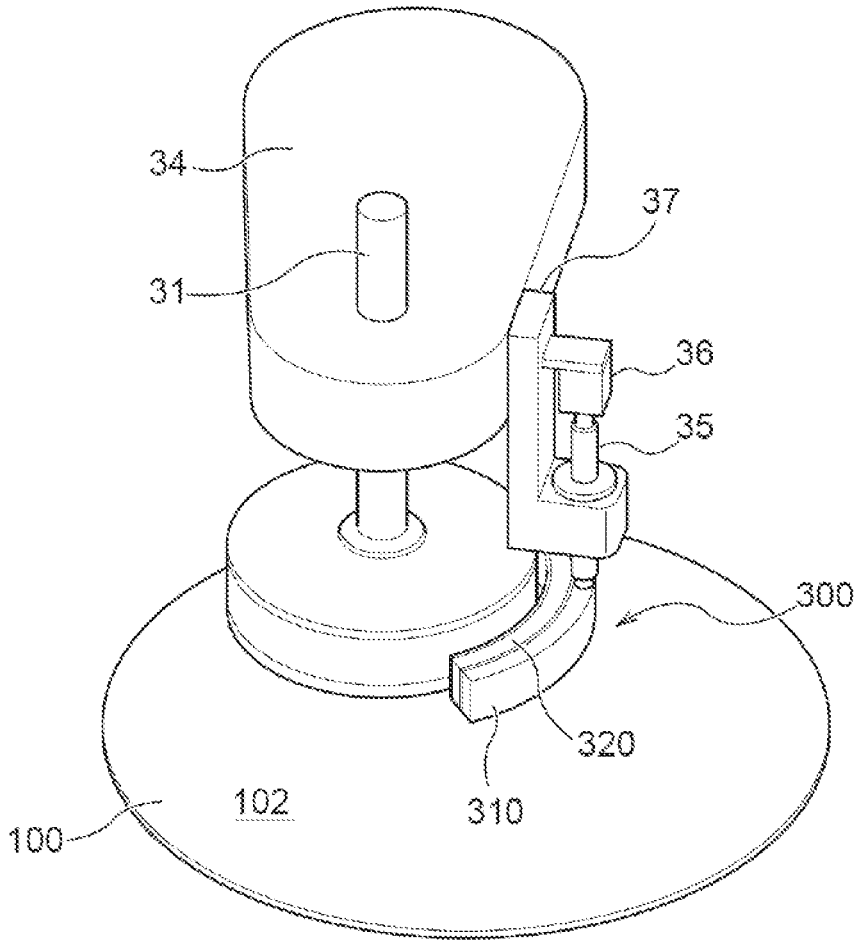
FIG. 37 is a perspective view showing an example of an attachment structure of the polishing-liquid removing unit.
Figure 38:
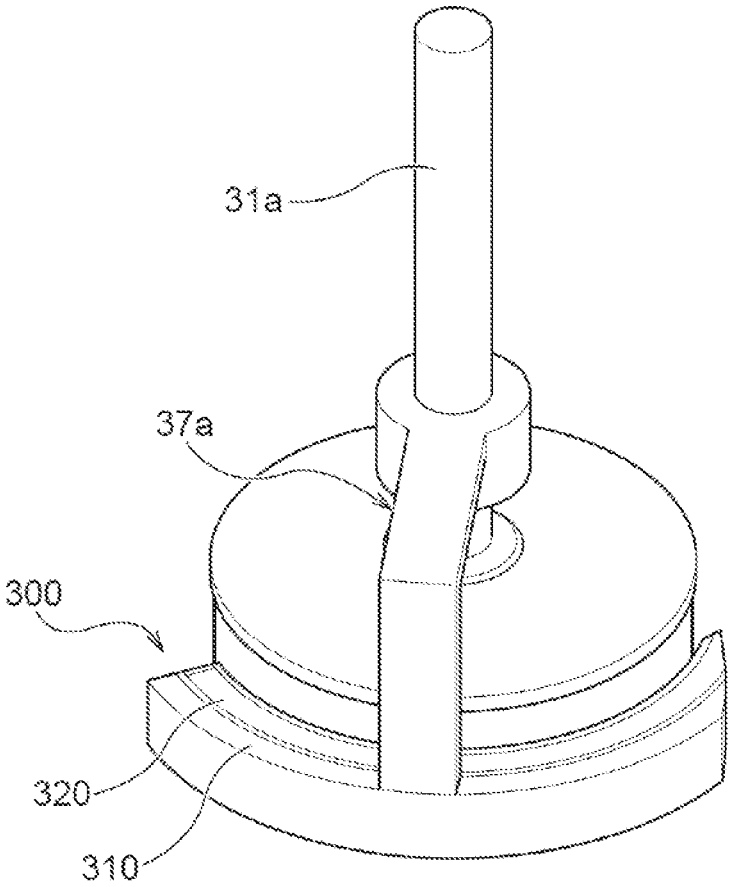
FIG. 38 is a perspective view showing an example of the attachment structure of the polishing-liquid removing unit.

FIGS. 37 and 38 are perspective views showing examples of an attachment structure of the polishing-liquid removing unit. In the example shown in FIG. 37, the polishing-liquid removing unit 300 is attached to the supporting arm 34 of the top ring 30 via a lifting and lowering guide 35 and a bracket 37. One end of a shaft of the lifting and lowering guide 35 is fixed to the sucking unit 310 of the polishing-liquid removing unit 300. The other end of the shaft of the lifting and lowering guide 35 is coupled to a rod of a cylinder 36. A force of the polishing-liquid removing unit 300 being pressed against the polishing surface 102 is adjusted by extension and retraction of the rod of the cylinder 36. One end of the shaft of the lifting and lowering guide 35 may be fixed to the cleaning unit 320 of the polishing-liquid removing unit 300 or may be fixed to both of the cleaning unit 320 and the sucking unit 310.

In the example shown in FIG. 38, the polishing-liquid removing unit 300 is fixed to a rotating/lifting and lowering shaft 31*a* of the top ring 30 via a bracket 37*a*. The bracket 37*a* can be fixed to the cleaning unit 320 and/or the sucking unit 310. By coupling the bracket 37*a* and the rotating/lifting and lowering shaft 31*a* via a rotary bearing and providing a whirl stop mechanism, the rotation of the rotating/lifting and lowering shaft 31*a* is prevented from being transmitted to the bracket 37*a*. With this configuration, the polishing-liquid removing unit 300 fixed to the bracket 37*a* is lifted and lowered in synchronization with lifting and lowering of the rotating/lifting and lowering shaft 31*a*. Consequently, the polishing-liquid removing unit 300 is pressed against the polishing surface 102.

According to this embodiment, similar functions and effects as those in the fourth embodiment are achieved. Further, the used polishing liquid and the byproducts immediately after the polishing treatment can be collected by the polishing-liquid removing unit 300. Since the polishing-liquid removing unit 300 has the shape conforming to the external shape of the top ring 30, it is possible to achieve space saving of the polishing-liquid removing unit 300.

As in the fourth embodiment, the opening section 328 may be provided at the radial-direction outer side end portion of the cleaning unit 320 or the entire circumference of the cleaning unit 320 may be surrounded by the sidewalls. In this embodiment, as in the example shown in FIG. 28, the dresser 90 and the atomizer 94 may be provided. The cleaning unit 320 of the polishing-liquid removing unit 300 may be used as an atomizer and the separate atomizer 94 may be omitted. The dresser 90 and the atomizer 94 may be omitted.

Sixth Embodiment

Figure 39:
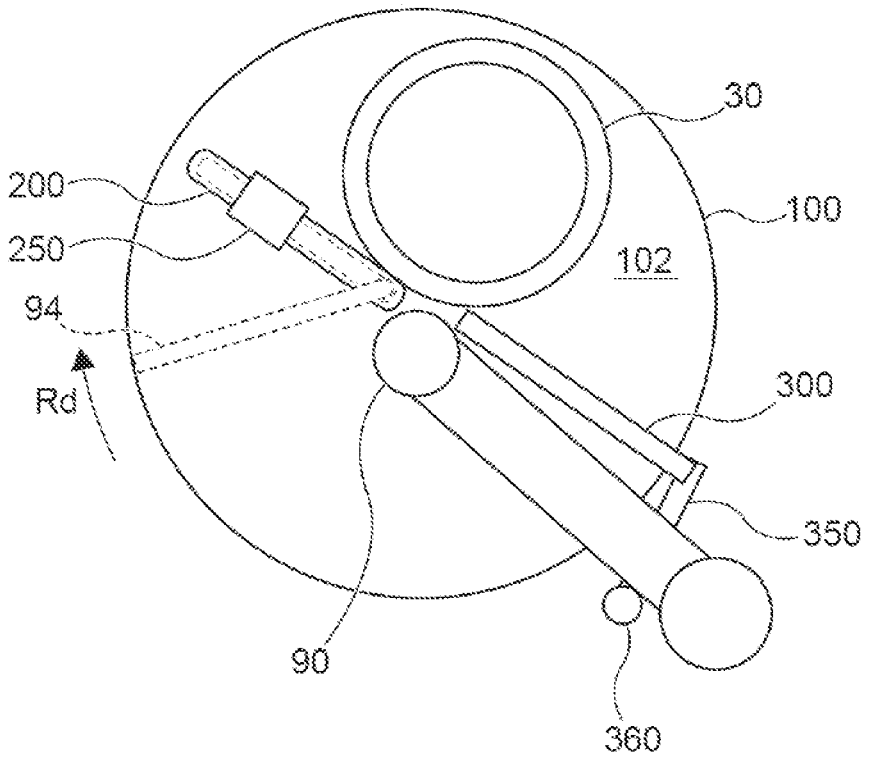
FIG. 39 is a plan view showing a disposition relation among components of a polishing apparatus according to a sixth embodiment.

FIG. 39 is a plan view showing a disposition relation among components of a polishing apparatus according to a sixth embodiment. In this example, the polishing-liquid removing unit 300 is provided in the polishing apparatus in the second embodiment. The polishing-liquid removing unit 300 may have the same configuration as the configuration of the polishing-liquid removing unit 50 explained above or the polishing-liquid removing unit 300 according to the fourth or fifth embodiment or may have another configuration. Instead of the supplying device 200 in the second embodiment, the slurry supplying device described in Japanese Patent Application Laid-Open No. H11-114811 (U.S. Pat. No. 6,336,850) may be combined with the polishing-liquid removing unit 300 according to the fourth or fifth embodiment. The entire disclosure including the specification, the claims, the drawings, and the abstract of Japanese Patent Application Laid-Open No. H11-114811 (U.S. Pat. No. 6,336,850) is incorporated in this application by reference.

The polishing-liquid removing unit 300 is desirably disposed in the rear (on the downstream side) of the top ring 30 and in the front (on the upstream side) of the supplying device 200 (the slurry supplying device). According to this embodiment, after the used polishing liquid is removed by the polishing-liquid removing unit 300, the used polishing liquid is discharged to the outside of the polishing pad 100 by the sidewall 211 on the primary side of the supplying device 200. Therefore, it is possible to further suppress the used polishing liquid from mixing in the polishing liquid output from the secondary side of the supplying device 200.

In this embodiment, as in the example shown in FIG. 28, the dresser 90 and the atomizer 94 may be provided. The cleaning unit 320 of the polishing-liquid removing unit 300 may be used as an atomizer and the separate atomizer 94 may be omitted. The dresser 90 and the atomizer 94 may be omitted.

The cleaning unit of the polishing-liquid removing unit 300 may be omitted. In this case, it is possible to reduce an amount of use of the polishing liquid by setting a suction pressure and a pressing force of the sucking unit 310 to an optimum pressure for removing only the polishing liquid (abrasive grains) ineffective for polishing present in the groove sections (the pad grooves; the porous portions) without completely removing the used polishing liquid on the polishing surface. The polishing liquid not removed by the sucking unit 310 is discharged on the primary side of the supplying device 200.

Seventh Embodiment

Figure 40:
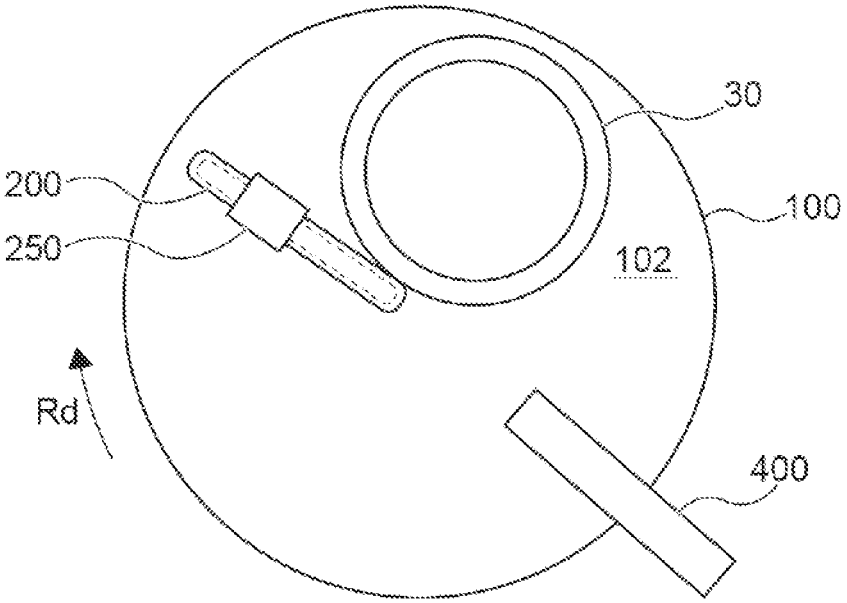
FIG. 40 is a plan view showing a disposition relation among components of a polishing apparatus according to a seventh embodiment.

FIG. 40 is a plan view showing a disposition relation of components of a polishing apparatus according to a seventh embodiment. In this example, a temperature adjusting unit 400 is provided in the polishing apparatus in the second or third embodiment. The temperature adjusting unit 400 may have the same configuration as the configuration of the temperature adjusting unit 60 (FIG. 4 and the like) and the temperature adjusting unit 60A (FIG. 8) explained above or may have another configuration. The temperature adjusting unit 400 is desirably disposed in the rear (on the downstream side) of the top ring 30 and in the front (on the upstream side) of the supplying device 200. As explained above, the temperature adjusting unit 400 may be controlled based on temperature detected by the temperature sensor 68. According to this embodiment, since the temperature adjustment of the polishing surface 102 can be performed, it is possible to improve polishing quality.

When the temperature adjusting unit 400 is provided in the polishing apparatus in the second embodiment, the polishing-liquid removing unit 300 explained above may be further provided. In this case, the supplying device 200, the top ring 30, the polishing-liquid removing unit 300, and the temperature adjusting unit 400 are desirably disposed in this order. In this case, the temperature adjusting unit 400 can adjust the temperature of the polishing surface 102 in a state in which the polishing liquid, which could be a heat insulating layer, is removed. It is possible to improve efficiency of the temperature adjustment of the polishing surface 102.

The supplying device 200, the temperature adjusting unit 400, the top ring 30, and the polishing-liquid removing unit 300 may be disposed in this order. In this case, the temperature of the polishing surface can be adjusted to temperature optimum for polishing immediately before the polishing treatment.

In this embodiment, as in the example shown in FIG. 28, the dresser 90 and the atomizer 94 may be provided. The cleaning unit 320 of the polishing-liquid removing unit 300 may be used as an atomizer and the separate atomizer 94 may be omitted. The dresser 90 and the atomizer 94 may be omitted.

At least the following modes can be grasped from the embodiments.

According to a first mode, there is provided a polishing apparatus that performs polishing of an object to be polished using a polishing pad having a polishing surface, the polishing apparatus including: a polishing table for supporting the polishing pad, the polishing table being configured to be rotatable; a substrate holding unit configured to hold the object to be polished and pressing the object to be polished against the polishing pad; and a polishing-liquid removing unit configured to remove polishing liquid from the polishing surface, wherein the polishing-liquid removing unit includes: a rinse unit configured to jet cleaning liquid onto the polishing surface; and a sucking unit configured to suck the polishing liquid on the polishing surface onto which the cleaning liquid is jetted, the rinse unit includes a cleaning space surrounded by a sidewall, and the sidewall includes an opening section for opening the cleaning space toward a radial direction outer side of the polishing table.

According to this mode, the polishing surface is cleaned while used cleaning liquid is discharged to the outside of the polishing pad in the cleaning space surrounded by the sidewall of the rinse unit (cleaning unit). The polishing liquid on the polishing surface is further sucked and removed in the sucking unit. Therefore, it is possible to improve removing performance of the polishing liquid on the polishing surface. Since the cleaning liquid is jetted onto the polishing surface in the cleaning space surrounded by the sidewall, it is possible to suppress the cleaning liquid from scattering. Since the used cleaning liquid is discharged from the sidewall opening section outward in the radial direction during the cleaning, it is possible to greatly reduce an amount of the polishing liquid sucked in the sucking unit. Consequently, a burden of the suction in the sucking unit is reduced.

According to a second mode, in the polishing apparatus according to the first mode, the rinse unit and the sucking unit are configured as an integral block or disposed adjacent to each other. According to this mode, the polishing-liquid removing unit can be disposed in a saved spaced. Since the rinse unit and the sucking unit are close to each other, it is possible to more surely suck, in the sucking unit, abrasive grains, by products, and the like separated from groove sections (pad grooves, porous, or the like) of the polishing surface by the cleaning.

According to a third mode, in the polishing apparatus according to the first or second mode, the polishing-liquid removing unit is disposed on an outer side of the substrate holding unit along an external shape of the substrate holding unit. According to this mode, it is possible to efficiently remove used polishing liquid on the polishing surface immediately after the polishing treatment. Since the polishing-liquid removing unit is provided along the external shape of the substrate holding unit, it is possible to dispose the polishing-liquid removing unit in a saved space.

According to a fourth mode, in the polishing apparatus according to the third mode, the polishing apparatus further includes a supporting arm configured to support the substrate holding unit, and the polishing-liquid removing unit is fixed to the supporting arm. According to this mode, it is unnecessary to separately provide a turning mechanism and/or a lifting and lowering mechanism for the polishing-liquid removing unit.

According to a fifth mode, in the polishing apparatus according to the third mode, the polishing apparatus further includes a lifting and lowering shaft configured to lift and lower the substrate holding unit, and the polishing-liquid removing unit is fixed to the lifting and lowering shaft. According to this mode, it is unnecessary to separately provide a turning mechanism and/or a lifting and lowering mechanism for the polishing-liquid removing unit.

According to a sixth mode, in the polishing apparatus according to any one of the third to fifth modes, the polishing-liquid removing unit has an arcuate shape. According to this mode, the polishing-liquid removing unit can be provided along an external shape of the substrate holding unit having a circular shape. Therefore, it is possible to dispose the polishing-liquid removing unit in a saved space.

According to a seventh mode, in the polishing apparatus according to any one of the first to sixth modes, the polishing apparatus further includes a pressing mechanism configured to press the rinse unit and/or the sucking unit against the polishing surface. According to this mode, it is possible to suppress, in the rinse unit, the cleaning liquid and the like in the cleaning space from flowing out to sections other than the opening section. It is possible to press the sucking unit against the polishing surface to make it possible to satisfactorily perform suction of the cleaning liquid in the sucking unit.

According to an eighth mode, in the polishing apparatus according to any one of the first to seventh modes, the polishing apparatus further includes a temperature adjusting unit disposed on a downstream side of the polishing-liquid removing unit in a rotating direction of the polishing table. According to this mode, the temperature adjusting unit can adjust the temperature of the polishing surface in a state in which the polishing liquid, which could be a heat insulating layer, is removed. It is possible to improve efficiency of temperature adjustment of the polishing surface.

According to a ninth mode, in the polishing apparatus according to any one of the first to eighth modes, the polishing apparatus further includes a supplying device for supplying the polishing liquid to the polishing surface in a state in which the supplying device is pressed against the polishing pad. According to this mode, after the used polishing liquid is removed by the polishing-liquid removing unit, the used polishing liquid can be further discharged by the supplying device (supply pad). Therefore, it is possible to more completely perform the removal of the used polishing liquid.

According to a tenth mode, there is provided a polishing method for rotating a polishing table attached with a polishing pad and pressing the object to be polished against the polishing pad to polish the object to be polished, the polishing method including: preparing a polishing-liquid removing unit including a rinse unit and a sucking unit; jetting, with the rinse unit, cleaning liquid onto a polishing surface of the polishing pad; discharging the jetted cleaning liquid from an opening section open to a radial direction outer side of the polishing table in a sidewall of the rinse unit; and sucking, with the sucking unit, polishing liquid on the polishing surface onto which the cleaning liquid is jetted. According to this mode, similar functions and effects as those in the first mode are achieved.

The embodiments of the present invention are explained above. However, the embodiments of the invention explained above are for facilitating understanding of the present invention and do not limit the present invention. It goes without saying that the present invention can be changed and improved without departing from the gist of the present invention and equivalents of the present invention are included in the present invention. Any combinations of the embodiments and the modifications are possible in a range in which at least a part of the problems described above can be solved or a range in which at least a part of the effects described above can be achieved. Any combinations or omission of the constituent elements described in the claims and the specification are possible.

The present application claims the benefit of priority to Japanese patent application No. 2018-147915 filed on Aug. 6, 2018. The entire disclosure of Japanese patent application No. 2018-147915 filed on Aug. 6, 2018 including specification, claims, drawings and summary is incorporated herein by reference in its entirety. The entire disclosure of Japanese Patent Application Laid-Open No. 2001-150345 (Patent Literature 1), Japanese Patent No. 4054306 (Patent Literature 2), Japanese Patent Application Laid-Open No. 2008-194767 (Patent Literature 3), and United States Patent Publication No. 2016/0167195 (Patent Literature 4) including specification, claims, drawings and summary are incorporated herein by reference in their entirety.

REFERENCE SIGNS LIST

10 polishing apparatus
20 polishing table

30 top ring
40 polishing-liquid supply nozzle
50 polishing-liquid removing unit
52 damming unit
56 sucking unit
57 slit
58 channel
60, 60A temperature adjusting unit
62 gas jetting nozzle
62A heat exchanger
70 control unit
100 polishing pad
102 polishing surface
200 supplying device
201 holding space
210, 211, 212 sidewall
250 pressing mechanism
251 cylinder device
251*a* cylinder
252 pressing-posture adjusting mechanism
300 polishing-liquid removing unit
310 sucking unit
320 cleaning unit
SL polishing liquid
Wk substrate

What is claimed is:

1. An apparatus for polishing of an object to be polished using a polishing pad having a polishing surface, the apparatus comprising:

a polishing table for supporting the polishing pad, the polishing table being configured to be rotatable;

a substrate holding unit configured to hold an object to be polished and pressing the object to be polished against the polishing pad; and a polishing-liquid removing unit configured to remove polishing liquid from the polishing surface, wherein the polishing-liquid removing unit includes:

a rinse unit configured to jet cleaning liquid onto the polishing surface and a sucking unit configured to suck the polishing liquid on the polishing surface onto which the cleaning liquid is jetted, the rinse unit includes a cleaning space forming an internal space which is surrounded by a sidewall and opens to the polishing surface, in which internal space the cleaning liquid is jetted onto the polishing surface, and the sidewall includes an opening section for opening the cleaning space toward a radial direction of an outer side of the polishing table, wherein the cleaning space is continuous to the opening section on the polishing surface, and the cleaning liquid, which is jetted on the polishing surface in the cleaning space, is discharged directly from the polishing surface in the cleaning space via the opening section, the sidewall is disposed on an upstream side and a downstream side in a rotating direction of the polishing table and on a center side of the polishing table so that the side wall surrounds the internal space on three sides, wherein the internal space laterally opens only at the opening section.

2. The apparatus according to claim 1, wherein the rinse unit and the sucking unit are configured as an integral block or disposed adjacent to each other.

3. The apparatus according to claim 1, wherein the polishing-liquid removing unit is disposed on an outer side of the substrate holding unit along an external shape of the substrate holding unit.

4. The apparatus according to claim 3, further comprising a supporting arm configured to support the substrate holding unit, wherein the polishing-liquid removing unit is fixed to the supporting arm.

5. The apparatus according to claim 3, further comprising a lifting and lowering shaft configured to lift and lower the substrate holding unit, wherein the polishing-liquid removing unit is attached to the lifting and lowering shaft.

6. The apparatus according to claim 3, wherein the polishing-liquid removing unit has an arcuate shape.

7. The apparatus according to claim 1, further comprising a pressing mechanism configured to press the rinse unit and/or the sucking unit against the polishing surface.

8. The apparatus according to claim 1, further comprising a temperature adjusting unit disposed on a downstream side of the polishing-liquid removing unit in a rotating direction of the polishing table.

9. The apparatus according to claim 1, further comprising a supplying device for supplying the polishing liquid to the polishing surface in a state in which the supplying device is pressed against the polishing pad.

10. A method for polishing an object to be polished by rotating a polishing table attached with a polishing pad and pressing the object to be polished against the polishing pad, the method comprising:

preparing a polishing-liquid removing unit including a rinse unit and a sucking unit, the rinse unit including a cleaning space as an internal space which is surrounded by a sidewall and opens to a polishing surface, in which internal space the cleaning liquid is jetted onto the polishing surface, the sidewall including an opening section for opening the cleaning space toward a radial direction outer side of the polishing table, the cleaning space being continuous to the opening section on the polishing surface, wherein the sidewall is disposed on an upstream side and a downstream side in a rotating direction of the polishing table and on a center side of the polishing table so that the side wall surrounds the internal space on three sides, wherein the internal space laterally opens only at the opening section;

jetting, with the rinse unit, cleaning liquid onto the polishing surface of the polishing pad in the cleaning space;

discharging the cleaning liquid, which is jetted on the polishing surface in the cleaning space, directly from the polishing surface in the cleaning space via the opening section open to a radial direction outer side of the polishing table in the sidewall of the rinse unit; and sucking, with the sucking unit, polishing liquid on the polishing surface onto which the cleaning liquid is jetted.

* * * * *